US012325545B2

(12) United States Patent
Tanner

(10) Patent No.: US 12,325,545 B2
(45) Date of Patent: Jun. 10, 2025

(54) BAND-WIDTH-ADJUSTABLE BANDEROLING MACHINE

(71) Applicant: ATS-TANNER BANDING SYSTEMS AG, Zug (CH)

(72) Inventor: Alois Tanner, Fahrwangen (CH)

(73) Assignee: ATS-TANNER BANDING SYSTEMS AG (CH)

( * ) Notice: Subject to any disclaimer, the term of this patent is extended or adjusted under 35 U.S.C. 154(b) by 293 days.

(21) Appl. No.: 17/998,993

(22) PCT Filed: May 20, 2021

(86) PCT No.: PCT/EP2021/063527
§ 371 (c)(1),
(2) Date: Nov. 16, 2022

(87) PCT Pub. No.: WO2021/239585
PCT Pub. Date: Dec. 2, 2021

(65) Prior Publication Data

US 2023/0211913 A1 Jul. 6, 2023

(30) Foreign Application Priority Data

May 28, 2020 (EP) ..... 20177161
Mar. 9, 2021 (EP) ..... 21161514

(51) Int. Cl.
*B65B 13/18* (2006.01)
*B65B 59/00* (2006.01)

(52) U.S. Cl.
CPC ..... *B65B 59/003* (2019.05); *B65B 13/185* (2013.01)

(58) Field of Classification Search
None
See application file for complete search history.

(56) References Cited

U.S. PATENT DOCUMENTS 4,502,911 A 3/1985 Discavage
5,070,676 A 12/1991 Laczkowski et al.
(Continued)

FOREIGN PATENT DOCUMENTS

DE 10026197 12/2001
DE 202017004069 8/2017
(Continued)

OTHER PUBLICATIONS

Project Service & Produktion (Feb. 10, 2020). Eco Banding—Proband V1000 [Video]. YouTube. https://youtu.be/JqqfP-kqeKk.
(Continued)

*Primary Examiner* — Chinyere J Rushing-Tucker
(74) *Attorney, Agent, or Firm* — Lerner David LLP

(57) ABSTRACT

A curved guide of a band-width-adjustable banderoling machine and a corresponding insert allow the curved guide to be adapted to bands of different widths. The curved guide mounted on the banderoling machine has a band guiding surface which is restricted on a first side and unrestricted on a second side. The insert has a restriction surface which, in the assembled state, is intersected by the continuation of the band guiding surface. The restriction surface is selected in such a way that in the assembled state the distance between the first side of the band guiding surface and the restriction surface is adapted to the width of the desired band. The restriction surface of the insert restricts the band guiding surface on the second side. In addition to such an adaptable curved guide, a banderoling machine preferably also comprises an adaptable band drive with an at least partially replaceable band channel.

33 Claims, 6 Drawing Sheets

(56) References Cited

U.S. PATENT DOCUMENTS

| | | | | |
|---|---|---|---|---|
| 6,957,678 | B2 | 10/2005 | Scholl et al. | |
| 2003/0121611 | A1 | 7/2003 | Scholl et al. | |
| 2008/0276578 | A1* | 11/2008 | Kastner | B65B 13/06 53/589 |

FOREIGN PATENT DOCUMENTS

| | | | |
|---|---|---|---|
| JP | 2002347706 | A | 12/2002 |
| TW | 248799 | | 6/1995 |

OTHER PUBLICATIONS

Search Report for Taiwanese Application No. 110119153 dated Nov. 7, 2024. 1 pg.

* cited by examiner

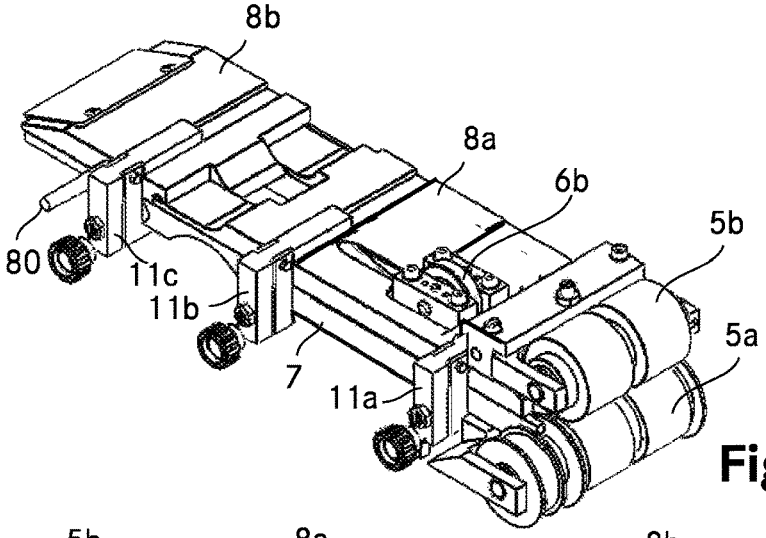
Fig. 8
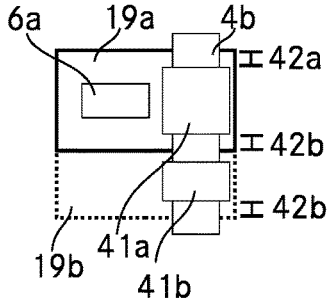
Fig. 7
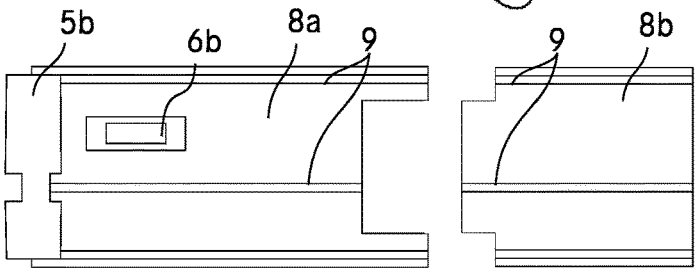
Fig. 9a
Fig. 9b
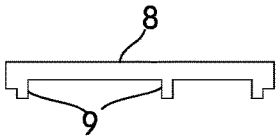
Fig. 9c
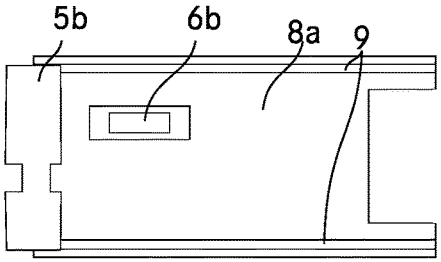
Fig. 10a
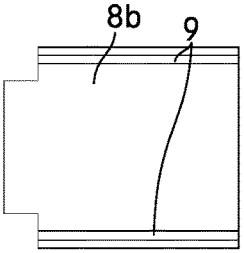
Fig. 10b
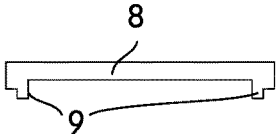
Fig. 10c
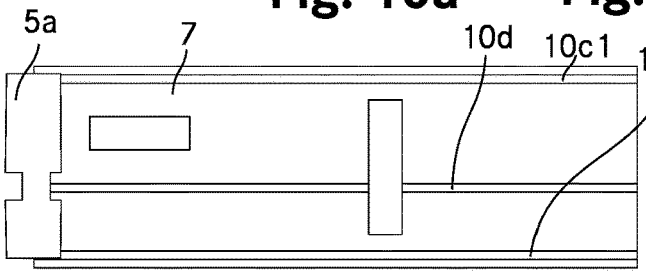
Fig. 11a
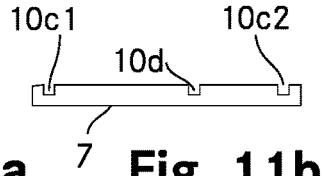
Fig. 11b
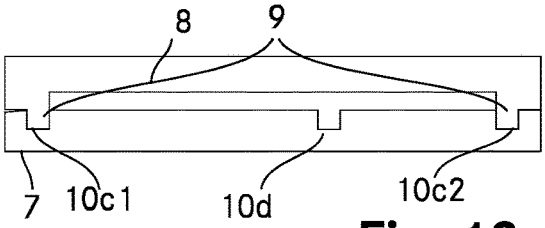
Fig. 12a
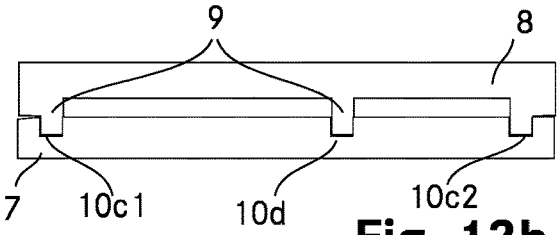
Fig. 12b

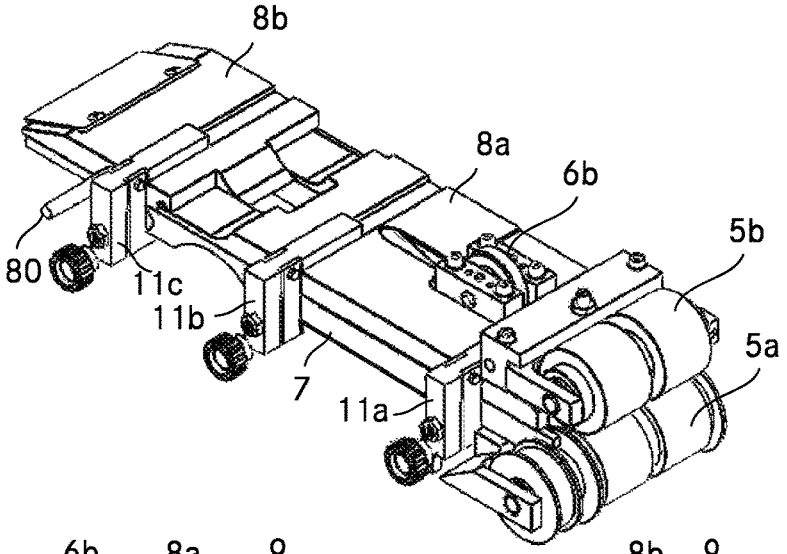
Fig. 13
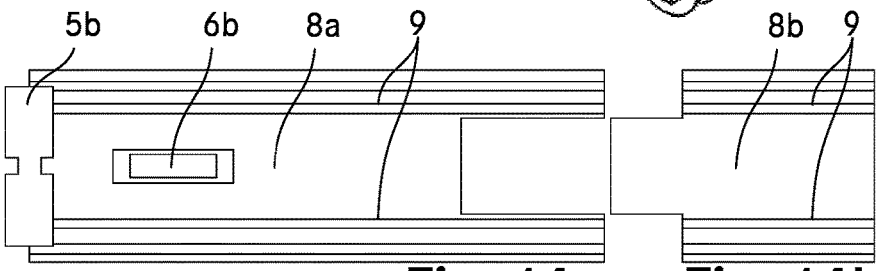
Fig. 14a
Fig. 14b
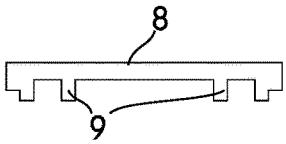
Fig. 14c
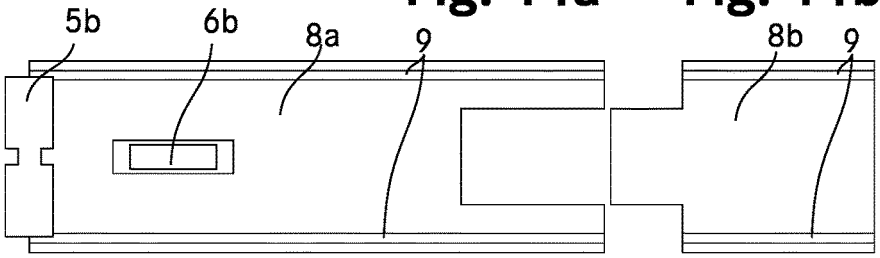
Fig. 15a
Fig. 15b
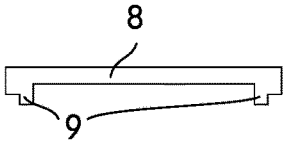
Fig. 15c
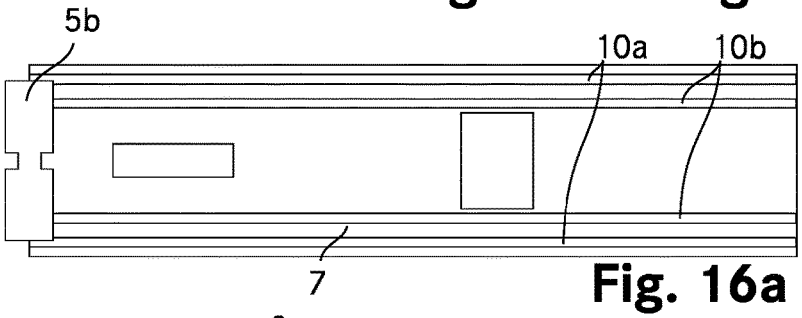
Fig. 16a
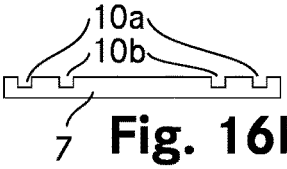
Fig. 16b
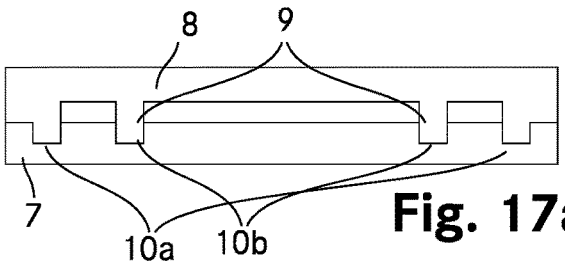
Fig. 17a
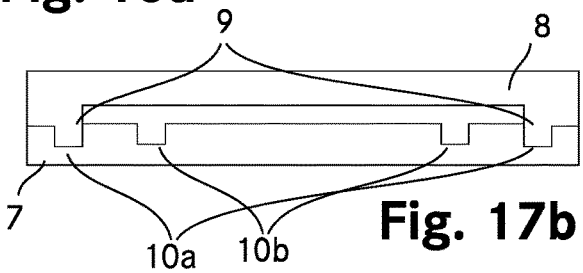
Fig. 17b

BAND-WIDTH-ADJUSTABLE BANDEROLING MACHINE

CROSS-REFERENCE TO RELATED APPLICATIONS

This application is the U.S. National Phase application of and claims priority to PCT Application No. PCT/EP2021/063527 filed May 20, 2021, which claims priority to the European Application EP20177161.5 filed May 28, 2020, and to European Application EP21161514.1 filed Mar. 9, 2021, all applications of which are incorporated herein by reference and made a part hereof.

BACKGROUND OF THE INVENTION

1. Field of the Invention

The invention relates to a banderoling machine that can use bands of different widths, to an insert for adapting a curved guide of such a banderoling machine to the different band widths, and to a curved guide that is compatible with the insert.

2. Description of the Related Art

Banderoling machines are used for packaging and labeling objects, such as food packages. They place a flexible band, typically made of a plastic or paper that may be printed, around the object, tighten it, seal it, and separate it from the band supply. Sealing is usually done by gluing or welding, with ultrasonic welding and heat welding being particularly suitable sealing methods.

Strapping machines have a similar effect: With these, a significantly stiffer and thicker strapping band is placed around objects and joined. The aim is primarily to bundle objects for storage and transport. The strapping is not designed for decoration characteristics, but for stability. Strapping bands are typically narrower, thicker, and less flexible than the bands used in banderoling machines. In addition, strapping bands are tightened more tightly and sealed in a particularly stable manner.

Banderoling machines in the sense of the invention should in particular be able to process bands with thicknesses of less than 300 μm.

Banderoling machines should work quickly and be able to process the thinnest possible wide bands. Thin, wide bands offer plenty of space for labeling, protect the object during banding and minimize the amount of packaging. However, the exact dimensions in individual cases, i.e. width and thickness of the band, depend on the object to be banded and the desired design of the band. Thin, wide and flexible bands have a tendency to slip into gaps during processing, to get caught in guides and thus to cause a band jam.

In particular, the present invention relates to a curved banderoling machine: Thereby the band is guided around the object in a curved guide before coming into contact with the surface of the object during tightening.

In order to avoid that a user needs several machines to process bands of different widths, there have been various attempts to make strapping machines adaptable to band widths: DE 100 26 197 A1 discloses a strapping machine that has a band stop in the area of the sealing mechanism that can be adjusted to the band width. U.S. Pat. No. 4,502,911 uses a channel in the area of the drive of a strapping machine whose width can be adjusted by means of a screw. However, both techniques only work with the comparatively stiff strapping bands: Bands for banderoling machines buckle when they are to be pushed laterally by a band guide into a predetermined position and jam in the gaps that have channels such as those proposed by U.S. Pat. No. 4,502,911.

For banderoling machines, DE 20 2017 004 069 U1 proposes the replacement of the curved guide to be able to use different bands. The video available at https://youtube/Jqq/P-kqeKk which presents the machine "Proband V 1000", which is available from Project Service & Production GmbH located in Kranenburg, Germany, shows that in this machine the adaptability is additionally achieved by exchanging a guide coil.

With these known solutions, strapping machines can probably be adapted, but the solutions for the banderoling machines are unsatisfactory, as they have to be operated more slowly to avoid errors, jamming and band jams. When tightening and retracting the band, the guide coil of the Proband V 1000 is located behind the drive unit and therefore cannot influence the course of the band inside this unit. The replaceable curved guide is also bulky and a component that is quite costly to manufacture.

Bands for banderoling are wide and thin. As a result, they readily adhere to the inside of guide channels. Thanks to their flexibility, they quickly form folds in the event of a locally somewhat increased friction, which press the band all the more strongly against the band channel and further increase the friction. The folds overlap until the band jams and the band channel becomes clogged. Similarly, lateral jamming in a gap in the band channel also increases friction.

Thus, small deviations from the optimum band routing are self-amplifying, and this problem becomes more serious the thinner, the more flexible, and the faster the band.

SUMMARY OF THE INVENTION

It is therefore an object of the present invention to provide a banderoling machine and accessories that allow the banderoling machine to be adaptable to different bands while operating reliably at high cycle rates. The adaptability is to be realizable with the help of compact and easy-to-manufacture parts.

The solution of the object is defined by the features of claims 1 and 7.

According to one embodiment of the invention, the curved guide of a band-width-adjustable banderoling machine allows adaptation to bands of different widths. The curved guide mounted on the banderoling machine has a band guiding surface. The band guiding surface is restricted on the first side and unrestricted on the second side. The curved guide can be adapted to bands of different widths by inserting an insert. The curved guide mounted on the banderoling machines has a clear opening and external dimensions.

The insert, which allows the curved guide to be adapted to bands of different widths, has a clear opening that is larger than or equal to the clear opening of the curved guide mounted on the banderoling machines. The insert has a restriction surface which, when mounted, is intersected by the extension of the band guiding surface. The restriction surface is selected such that, in the assembled state, the distance between the first side of the band guiding surface and the restriction surface is adapted to the desired width of the band.

The insert is much easier to manufacture and more compact than a complete curved guide. Since the clear opening of the insert is larger than or equal to that of the curved guide, the size of the bandable objects is not affected by the insert. The insert replaces the usually provided restriction on the second side of the band guiding surface. By restricting the band guiding surface on only one of its long sides, a wider band can extend beyond the band guiding surface and thus be guided by a band guiding surface that is narrower than the band.

Surprisingly, it has been found that the restriction of the second side realized by the restricting surface of the insert or the restriction realized by the cover can also reliably insert and hold bands that are significantly wider than the band guiding surface. This is particularly the case when the band is pressed against the band guiding surface by means of negative pressure.

However, if a band tends to twist or slip into a gap between the second side of the band guiding surface and the insert during insertion, the insert can be designed in a stepped manner: In this embodiment, the insert continues the band guiding surface in the area between the second side of the band guiding surface and the restriction surface, thus filling the gap.

The distance between the first side of the band guiding surface and the restriction surface is preferably matched to the desired width if it is only slightly larger than the width of the band. The distance preferably equals the width of the band channel in the band drive for the corresponding band. Therefore, the spacing is preferably 1 to 1.05 times the band width.

In a preferred embodiment, the insert comprises a set of at least two parts. This insert has the shape of an arc, preferably open on at least one straight section. The outer dimensions of this arc are smaller than or equal to the outer dimensions of the curved guide for the band. The outer dimension of each individual part is smaller than the clear opening of the curved guide.

This embodiment allows the insert to be stored in a particularly compact manner and also to be inserted from the inside. Thus, the band guiding surface can be surrounded by a cover, which can remain mounted even during the assembly of the insert. This cover can be closed towards the outside. The band guiding surface is thus well protected and no consideration needs to be given to its adaptability in the environment of the banderoling machines. An interruption of the arc of the insert on straight sections gives the parts of the insert play during assembly and disassembly without affecting the action of the insert. Preferably, the openings comprise less than 20% of the length of the section.

In another embodiment, the insert consists of only a single part, which is pushed against the band guiding surface from below, above or laterally. If it is inserted from above or laterally, the cover preferably has a corresponding gap for this purpose. If the insert is pushed in from below, there is preferably a corresponding opening in the table.

An insert consisting of one or more parts can also be brought directly up to the band guiding surface from behind and mounted there. This type of mounting is particularly suitable for embodiments in which there is no cover, the cover is formed by the insert in the area of the rear wall, or in which the cover is removed for mounting the insert.

In a preferred embodiment, the insert comprises exactly four parts. Each of the parts forms one corner of a substantially rectangular arc.

This embodiment combines a convenient assembly, in which the user hardly has to consider in which orientation to insert the parts into the cover, with a secure guidance of the band: Indeed, it is especially the corners in which the band relies on the correctly aligned and arranged restriction surfaces.

In a preferred embodiment, each of the parts of the insert is provided with a first half of a fastening system.

In a preferred embodiment, the curved guide for each of the parts of the insert is provided with a second half of the fastening system.

In particular, the fastening system allows the insert to be attached to and detached from the curved guide without the use of tools.

The fastening system ensures that the insert and the band guiding surface remain at the desired distance from each other during operation and that there is no movement relevant to the functionality. Tool-free fastening allows convenient and rapid adjustment of the banderoling machine, even in places where tools are not at hand.

In a preferred embodiment, the fastening system is a latching system. Preferably, the first half of the latching system comprises a blind hole equipped with a resilient thrust piece. The associated second half of the latching system comprises a socket pin mounted on the curved guide with a corresponding groove. The first and second halves of the latching system may cooperate with each other.

Preferably, the second half of the latching system comprises, in particular, a socket pin with a groove mounted on the curved guide. The associated first half of the latching system comprises a blind hole formed in the parts of the insert and provided with a resilient thrust piece. The first and second halves of the latching system may cooperate with each other.

In a particularly preferred embodiment, the latching system enables twist-proof fastening. For this purpose, either the first half of the latching system comprises two or more blind holes equipped with resilient thrust pieces and the second half of the latching system comprises two or more socket pins, each provided with a groove, which are linearly independent of one another in their respective direction of extension. Or the blind hole equipped with the resilient thrust piece is formed in a region of the insert that is not rotationally symmetrical in the strict sense about the direction of expansion of the blind hole, and the socket pin provided with a groove is attached to the curved guide in a complementarily shaped region that is also not rotationally symmetrical in the strict sense about the direction of expansion of the socket pin. These complementarily shaped areas on the curved guide and on the parts of the insert can interact to prevent rotation.

The socket pin and blind hole allow a positionally stable connection that hardly loosens even under vibration, but can be easily released by the user by means of pressure or traction. The user can feel the locking action, which confirms that the fastening has been carried out. If only a single pin/blind hole combination is used for the insert, the insert may rotate around this bolt under unfavorable conditions. To prevent this and ensure precise band guidance, either a second pin/blind hole combination can be used or the fastening area is designed in such a way that rotation around the pin is precluded by a form fit. Areas that are rotationally symmetrical in the narrower sense are bodies of rotation about the pin axis or about the direction of expansion of the blind hole. A region that is not rotationally symmetrical in the strict sense about the direction of expansion of the blind hole is, for example, a section of a square pyramid.

In one of the embodiments, each of the parts of the insert is provided with a handle recess.

This provides an intuitive guide for assembly and disassembly of the insert: as the user holds the handle recess in his hand, it provides an orientation of the insert relative to the curved guide.

The use of a handle recess also has the advantage over a protruding handle that the insert can have a plate-like design, and the parts of one or more inserts can be stacked particularly easily and stored in a space-saving manner.

In a preferred embodiment, the curved guide comprises a cover. The cover surrounds the band guiding surface and a volume for receiving the insert.

The cover protects the band guiding surface from environmental impact and shock. At the same time, the cover can serve as a support structure of band guiding surface and/or for positioning the insert. For a positioning function, for example, the cover can have grooves or rail-like structures into which the parts of the insert are inserted. If the cover serves both as a support structure for the band guiding surface and for positioning the insert, the insert can be arranged with high precision relative to the band guiding surface.

In another embodiment, the band guiding surface is self-supporting and is used without a cover. In this embodiment, the insert is mounted in particular directly to the band guiding surface or to the table of the banderoling machine.

In a preferred embodiment of the curved guide, the distance between the first and second sides of the band guiding surface is adapted to the width of the narrowest band. An insert can be mounted relative to the band guiding surface such that the distance between the restriction surface and the first side of the band guiding surface is adapted to the width of a particular desired band. In a particularly preferred embodiment, the distance between the inner wall of the cover and the first side of the band guiding surface is adapted to the width of the widest band.

The band guiding surface supports and guides the band in the curved guide particularly well. To achieve reliable guiding, it is therefore advantageous for as large a proportion of the band as possible to rest on the band guiding surface. However, reliable band guidance is also promoted by a restriction on both sides adapted to the width of the band. By selecting a band guiding surface that is just as wide as the narrowest band to which the banderoling machine is to be adapted, these two requirements are optimally combined. The use of the cover as a restriction surface for the widest bands also has the advantage that no insert has to be kept available for the widest bands.

According to the invention, a band-width-adjustable banderoling machine suitable for banding an object with different bands comprises an adjustable band drive and a band-width-adjustable curved guide.

The band drive includes a band channel and at least one drive roller. The drive roller is adapted to drive the different bands in the area of the band channel. The band channel is at least partially interchangeable and can be selected to be adapted to the width of one of the different bands. Thus, the band drive is designed to be adaptable to the different bands.

Due to the partial interchangeability, the band channel is preferably also adaptable to bands of different thicknesses, so that the banderoling machine is suitable for using bands that differ in width and thickness and can preferably be thinner than 300 μm as banding material.

The invention thus guides the band in the band channel, and thus at that point where it is accelerated. Since virtually every section of the band is set on the correct path on its own, guiding errors elsewhere, for example in the curved guide, can be absorbed and compensated for by the preceding and following band sections: The error does not build up, but weakens. Preferably, moreover, the band channel is adapted not only to the width of the band but also to the band thickness. This prevents the band from wrinkling: The band lacks the space to do so.

Thus, by adapting the band channel to the width and preferably the band thickness, adaptation of the band drive is realized, and by adapting the band drive, adaptation of the banderoling machines is also realized.

The band channel is preferably designed in such a way that its outer side is substantially the same in all adaptation variants and only the cavity for the band running in its interior is adapted to the respective band. The inner cross-section of this cavity is preferably somewhat larger than the cross-section of the band for which it is intended, so that the band is guided securely but at the same time does not rub excessively against the channel walls.

By interchangeable, for the purposes of this application, is meant interchangeability for a user of the machine, that is, a technical layman. In particular, the necessary actions should be performable without or with only a few common tools, such as a single socket wrench, and the parts and attachment points should be easily accessible and graspable.

Preferably, the drive roller remains mounted and in its operating position while the band channel is at least partially replaced.

In a preferred embodiment of a banderoling machine according to any of the preceding claims, the outer dimensions of the band drive and the position of a first longitudinal side of the band channel relative to the band drive are not changed by the adaptation to bands of different widths. The adaptation of the band drive to bandes of different widths is achieved by adjusting the position of a second longitudinal side of the band channel relative to the band drive. In a particularly preferred embodiment, adaptation of the band drive to different band thicknesses is achieved by adjusting the height of the channel cover relative to the band drive.

All bands thus run with their first edge along the first longitudinal side of the band channel in a band drive according to this embodiment. In a banderoling machine, the band channel of the band drive guides the band onto the band guiding surface of the curved guide. In the present embodiment, the band guiding surface is limited only on the first side while the limitation on the second side can be adjusted by the insert. The first side of the band channel and band guiding surface thus provides a guiding surface for all bandes, regardless of their width and without the need to change the positioning of the band drive and the band guiding surface relative to each other during adjustment. Bands of any width use the good guidance provided by the band guiding surface as far as possible for the respective band. A banderoling machine according to this embodiment is therefore particularly reliable and easy to adjust.

In a preferred embodiment of a banderoling machine, the channel sides and the channel top of the band channel are realized by side components. All side components of this embodiment are replaceable, while the bottom component remains installed in the banderoling machine. The bottom component is equipped with at least one notch and two edge steps, which extend parallel to the longitudinal axis over the entire length of the channel. The distance between the facing edges of the at least one notch and one of the edge steps is adapted to the width of a narrower band, and the distance between the facing edges of the two edge steps is adapted to the width of the widest band. Preferably, for each of the bands there is a front and a rear side member, the sections of which forming the channel side walls can engage the corresponding notch and the associated edge step of the bottom member. The bottom component and the side components thus complement each other to form a band channel with an internal cross-section having a width and a height adapted to the width and preferably the band thickness of one of the different bands.

In this preferred embodiment, the adaptation of the band channel is thus achieved solely by replacing the side component or components. All side components are positioned relative to the bottom component by the edge steps. Since the channel sidewall-forming sections of the side component contact the bottom component below the channel bottom, the guided band cannot be pinched between the bottom and side components and is thus guided particularly reliably.

In a preferred embodiment, the drive roller and/or its counter pressure roller has several contact areas. In operation with the band inserted, there are two distances which should be the same. One distance is the distance between the first edge of the band and the first outer edge of the support areas closest to this first edge and resting on the band. The other distance is that between the second edge of the band and the second outer edge, nearest to this second edge and resting on the band, of one of the support regions.

In a particularly preferred embodiment, these distances are the same for all intended widths of bands.

In the simplest form of such a drive roller, a first support area thus has the width of the narrowest band minus twice the width of a clearance area. This first support area is at a distance of the width of a clearance area from the channel side wall on the first side and thus comes to lie centered on the narrowest band. The second support area determines its extension and position on the basis of the next largest width of one of the adjustable bands: The second outer edge of the second support area is the width of a clearance area away from the second edge of this band. The first outer edge of the second support area is more than a width of a clearance from the second outer edge of the first support area and therefore does not contact the narrowest band. Thus, in operation, both the first and second support areas rest on the band with the next largest width. On the first side of the first support area, a free area remains in this operating situation whose width corresponds to the width of the free area on the second side of the second support area, whereby on both free areas the band has no contact with a support area. Further support areas can be dimensioned and positioned analogously.

A drive roller structured in this way drives bands of different widths uniformly and thus permits particularly reliable operation of the banderoling machines.

In a particularly preferred embodiment, an encoder wheel is offset towards one side of the channel in such a way that it rests on the narrowest band over its entire width during operation.

Since an encoder wheel is designed in such a way that it does not influence the band in its movement as far as possible, but serves solely for length measurement, a symmetrical arrangement is not necessary. For reliable measurement, however, complete contact with bands of all widths is advantageous. The offset arrangement therefore allows reliable measurement values to be acquired for all bands of all widths with only one encoder wheel in a fixed position.

The adaptation of the banderoling machines according to the invention to a band with a desired width comprises the adaptation of the band drive and the adaptation of the curved guide to the width of the desired band. The band drive is adapted to the width of the desired band in particular by at least partially replacing the band channel. Adapting the curved guide to the width of the desired band is done by inserting an insert.

In a particularly preferred embodiment, the user thus only needs to have corresponding side parts of the band channel and the corresponding insert at hand in order to quickly adapt the machine to the width of a desired band without tools.

In one embodiment, the band channel has recesses through which the drive roller can act on a band guided inside the band channel.

In particular, an input drive roller is arranged at the inlet of the band channel, which can act on the band.

Particularly preferably, a counter pressure roller is associated with both the drive roller and the input drive roller. In this way, the band can be clamped between the drive roller and its associated counterpressure roller and between the input drive roller and its associated counterpressure roller and accelerated and/or decelerated by the driving of the rollers.

Preferably, the band drive is equipped with an encoder that measures the band length laid around the object. The encoder detects the movements of an encoder wheel to determine which band length has been injected and/or retracted. For this purpose, this encoder determines the revolutions of an encoder wheel with a known diameter. Since the band should not slip over the wheel for the measurement, but should actually set it in motion, a counter pressure wheel is preferably assigned to the encoder wheel. This reduces slippage and associated measurement errors. Preferably, the band channel has recesses for encoder wheel and, if necessary, for the counterpressure wheel. Preferably, the encoder wheel is arranged between the input drive roller and the drive roller.

If the drive roller drives the band inside the band channel, it is easier to place the band on the drive roller: Once it is in the channel, it is also correctly positioned in relation to the drive. In addition, the band is guided with particular precision and independently of direction: Both when shooting in and when retracting and tightening, the band is guided before and after the point of application of the drive roller.

An input drive roller has several advantages. On the one hand, it facilitates threading of the band: If it lies against the easily accessible input drive roller, it pushes it precisely and evenly into the channel. The user is spared the need to push the band in further by hand. On the other hand, the use of the two drive rollers, i.e. the drive roller and the input drive roller, prevents a band jam, since the band is always pushed between them from one side and pulled from the other. Since the drive roller and the input drive roller are preferably synchronized, a band that is locally stuck in the band channel is quickly tensioned again. Finally, in this way, the power transmission is also distributed over a larger area of the band. Since the band has to be accelerated and decelerated again to achieve a high number of cycles, distributed force transmission protects the band and, if necessary, its printing.

The use of counterpressure rollers also helps to protect the band and improve power transmission: Without such, the band is pressed against a channel wall by the drive roller and pulled over it. In addition, an elastic coating on the counter pressure roller can compensate for fluctuations in band thickness and reduce band slippage.

To ensure that the drive roller and, if applicable, the input drive roller and the counter pressure rollers both grip well regardless of the band thickness, the counterpressure rollers can, for example, be spring-mounted or equipped with an elastic running surface, for example made of rubber. With such solutions, the user of the machine does not need to make any adjustments to the rolls and their bearings. In another embodiment, however, the counterpressure rollers are also replaceable. They can then be attached to the replaceable part of the band channel or be replaceable independently of the replaceable part of the band channel and be adapted in diameter to the band thickness. Also, the materials of the running surfaces and of the band can be selected to be adapted to each other, so that the band has little slip on the one hand and the band material and its printing are not attacked on the other hand.

In a preferred embodiment, the band channel has a substantially rectangular inner cross-section. The inner cross-section preferably has a width which corresponds to the sum of the width of the band and a width tolerance of preferably less than 5% of the band width. This width is determined by channel sidewalls. The inner cross section preferably has a height corresponding to the sum of the thickness of the band and a height tolerance of preferably more than 0.2 mm and less than 10 times the band thickness. This height is determined by a channel bottom and a channel top. In this embodiment, the channel sidewalls are uninterrupted along their height.

The height and width of the channel should be such that the band is guided securely but does not rub against the channel walls.

Preferred banderoling bands have a width between 25 mm and 100 mm and a thickness between 50 and 250 μm.

For these bands, it has been found to make the band channel less than 5% wider than the respective band but particularly preferably about 1 mm wider than the band width.

Similarly, it has been found that the band can be guided particularly well if it has about 0.2 mm more space in the band channel in height than the band is thick. However, if the band channel is higher than about 10 times the band thickness, reliability decreases.

To prevent the bands from getting caught on the channel sidewalls or jammed in gaps, the channel sidewalls are uninterrupted along their height. There are therefore no gaps extending in the direction of band travel. On the other hand, it is quite possible and also preferred in the area of the drive roll or a counter pressure roll that the channel side walls do not extend over the entire height of the channel or are even completely missing. Due to such shortened or missing channel side walls, a wide drive roller or a wide counter pressure roller can also be used for driving narrower bands.

One possibility for producing uninterrupted channel sidewalls in height is to manufacture the band channel as a whole from one workpiece.

In a preferred banderoling machine, the channel side walls and preferably the channel top are realized by one or more side components. A channel bottom is realized by a bottom component. In this case, all side components lie against the bottom component below the channel floor.

In another preferred embodiment, the channel side walls and preferably the channel bottom are realized by one or more side components and a ceiling component realizes the channel ceiling. All side components abut the ceiling component above the channel ceiling.

In another embodiment, the channel side walls are realized by side components, the channel floor is realized by a bottom component and the channel ceiling is realized by a channel component and the side components are located above the channel ceiling on the ceiling component and below the channel floor on the bottom component.

The band channel should be manufactured very precisely. This is simplified by the multi-part shape. In order to still achieve uninterrupted channel side walls, the walls attach above and/or below the inner cross section of the band channel. For the guided band, the attachment area of the side components is thus inaccessible and the risk of the band becoming trapped is reduced.

In one embodiment, the banderoling machines comprises a housing with a band insertion opening. The band drive is arranged inside the housing. In the operating state, the band is preferably guided, coming from a supply roll or a band accumulator, through the band insertion opening to the band drive located inside the housing. At least a portion of the band channel in this embodiment can be replaced by pulling it out through the band insertion opening and putting it back into its operating position.

Thus, the embodiment utilizes an existing opening in the housing to allow for interchangeability. The user thus has little contact with the inner workings of the machine. The likelihood of misoperation is reduced and user comfort is increased.

In one embodiment, all actions necessary to adjust the band drive can be done from a single side or through the band insertion opening. In this embodiment, the drive roller and, if applicable, the input drive roller and the drives of the drive roller and input drive roller remain unchanged in their operating position while the adjustment is made. Preferably, the counter pressure roller of the drive roller is coupled to the drive roller and is thus driven synchronously. A possibly existing counter pressure roller of the input drive roller and/or the counter pressure wheel of the encoder, however, preferably run along. Particularly preferably, the coupling of the drive roller and its counter pressure roller is realized by gear wheels mounted on the axles of the drive roller and its counter pressure roller.

This embodiment has the advantage that the adjustment of the band drive is easy to perform and the user does not have to change his location or reach deep into the machine.

If the drive roller and the counter pressure roller are both driven synchronously, the band is accelerated particularly gently and precisely. Since the band channel preferably runs both in front of and behind the drive roller and is preferably adaptable to the band on both sides of the drive roller, the drive roller and/or its counter pressure roller pose an obstacle to interchangeability. A simple and robust solution is to remove the counter pressure roller from its operating position for replacement, for example by removing, lifting or moving it. A simple way to couple the counter pressure roller and the drive roller in the operating position, without tools and adjustment, is to equip both rollers with gears that mesh in the operating position. In this way, the motor can directly drive the drive roll and, if necessary, the input drive roll, and the drive roll in turn can drive its counter pressure roll. All of the rolls directly driven by the motor can thus be arranged on one side of the band channel and remain there permanently mounted and connected to the motor during replacement.

In a preferred embodiment, only a portion of the band channel is replaceable. A band drive that achieves its adaptability by replacing only a portion of the band channel is hereinafter referred to as a first type band drive.

In a preferred embodiment of a band channel of the first type, the channel side walls and the channel ceiling are realized by side components. In this embodiment, all side components are interchangeable, while the bottom component, which realizes the channel bottom, remains installed in the banderoling machine.

In this embodiment, the relative position of the bottom component and the drive roller remains unaffected by the adjustment. Errors by the user can hardly occur, so that the band drive of the first kind is particularly reliable. In addition, a band drive of the first type requires hardly any more space in the machine than a conventional band drive. Thus, a band drive of the first kind can be retrofitted in some existing machines by replacing the conventional band drive with a band drive of the first kind by a person skilled in the art.

In one embodiment of a band channel of the first type, the band channel is formed by exactly one front side member, one rear side member and one bottom member. In this case, the front side component completes the band channel in front of the drive roller in the band feed direction, and the rear side component completes the band channel behind the drive roller.

The two-part design of the side component is particularly helpful when a counter pressure roll is assigned to the drive roll: This allows the rear side component to be pushed from behind to the point where the drive roll and counter pressure roll are closest to each other, and the front side component to be pushed from the front. It is therefore not absolutely necessary to remove the rollers. However, it can simplify the replacement if the counter pressure roller is removed before it is pushed in. Since the counter pressure roller may simply be mounted on its shaft, it can be easily removed and replaced. Preferably, the counter pressure roller is secured on its shaft to prevent it from slipping off. However, this securing can be designed to be tool-less or releasable with a simple socket wrench, for example in the form of a screw with a widened head or as a latching system.

In one embodiment of a band channel of the first type, the bottom component is provided with several pairs of notches. These notches are arranged symmetrically with respect to the longitudinal axis of the channel and extend parallel to the longitudinal axis along the entire length of the channel. The facing edges of a pair of notches are each spaced apart by a distance adapted to the width of a respective one of the different bands. In this embodiment, there is a front and a rear side member for each of the bands. Sections of the side members forming the channel sidewalls can engage the corresponding pair of notches of the bottom member so that the bottom member, front side member and rear side member complement each other to form a band channel having an internal cross-section with a width and a height adapted to the width and thickness of one of the different bands.

The notches thus fulfill two functions: On the one hand, they ensure that the side components rest against the bottom component below the channel bottom. On the other hand, they guide the side components and thus allow the necessary precise positioning in a simple manner. If a pair of notches is located at the first and second edges of the bottom component, this pair of notches represent edge steps.

In one embodiment of a band channel of the first type, the front side component is provided with the counter pressure roller to the input drive roller and preferably with a counter pressure wheel to an encoder wheel.

The encoder is preferably arranged between the input drive roller and the drive roller. Therefore, the band channel preferably and in particular in the area of the front side component, also has recesses for the encoder wheel and the counter pressure wheel.

The band channel of the first type can be used particularly well if it allows the side components to be simply pushed on or put on without having to move or dismantle other components of the banderoling machines. Therefore, it is a simple solution to mount the passively driven wheels and rollers directly at the appropriate location on the side component. This also has the advantage that the diameter of the counter pressure wheel and counter pressure roller to the input drive roller can be selected to match the desired band thickness and, if desired, the band material.

In an embodiment of a band channel of the first type, the front side component can be pushed in and pulled out through the band entry opening, while the rear side component is particularly preferably equipped with a laterally projecting handle by means of which it can be removed from the bottom component and rearranged transversely to the longitudinal direction of the operational band channel.

In this way, the side components can be replaced particularly conveniently and the risk of incorrect operation is reduced.

Preferably, the side components of a first type of band channel can be fastened to bottom component by means of clips which can be detached and attached without tools.

Although the accommodation of the side components in the notches and/or the edge steps of the bottom component prevents the side components from slipping laterally, the side components are not secured against displacement in the direction of the longitudinal axis of the channel and against lifting in this simplest form. If there is neither a counter pressure wheel nor a counter pressure roller on the side member, the forces acting on it are rather small. Nevertheless, securing helps to increase the reliability of the banderoling machines. This securing can be achieved with the preferred clamps. If both side and bottom components are equipped with grooves or otherwise designed devices for receiving U-shaped clamps, securing can be achieved particularly reliably by sliding on such clamps. The clips can in turn be secured against slipping by a spring-loaded pin or a screw that can be tightened by hand.

Preferably, there are exactly three clamps. Of these, a first engages between the input drive roller and the encoder wheel, a second engages between the encoder wheel and the drive roller, and a third is located on the other side of the drive roller.

The third clamp of this embodiment is the only one that secures the rear side member.

In this embodiment, the first and second clamps are located in front of and behind the encoder wheel, allowing the counter pressure wheel to press the band against the encoder wheel with the desired pressure.

In this way, optimal fastening for correct functioning can be achieved with the smallest possible number of simply shaped clamps, which are thus inexpensive to manufacture and easy to replace.

In another embodiment of a banderoling machine, the band channel is replaceable as a whole.

A band drive which achieves its adaptability only by replacing the band channel as a whole is referred to below as a second type of band drive.

Since the band channel is not assembled by the user but is available as a whole, it can be manufactured more precisely. Also, the replacement can be further simplified.

In a preferred embodiment of a band drive of the second type, the band channel is formed in one piece. The bottom component of the band channel has a plurality of parallel recesses in the region of the drive roller and the input drive roller. Preferably, the bottom component has a further recess for an encoder wheel.

In this embodiment, the surfaces of the drive roller and the input drive roller are structured in such a way that, in the operating state, parts of the surfaces protrude through the recesses in the bottom component and can come into contact with a band guided in the band channel. Preferably, the counter pressure rollers have a substantially unstructured surface.

By a one-piece design is meant here a component that is supplied by the manufacturer in one piece and is not intended to be taken apart by the user. However, it may well be made of different materials and assembled from different components in its manufacture.

Since the band channel is to be replaced as a whole, it preferably has a certain inherent stability. In order to achieve this and also to allow the greatest possible contact between the drive roller or input drive roller and the band, the use of a large number of recesses is particularly suitable. To ensure that the action of the rolls is not impeded by the webs separating the recesses from one another, the running surfaces of the rolls are themselves preferably structured. On the top of the channel, on the other hand, the use of a large recess corresponding to the width of the counter pressure rollers is a good idea: further increasing stability has proved unnecessary in practical use, while the size of the recess simplifies band insertion and band channel maintenance.

In one embodiment, both the bottom component and the top component are provided with a plurality of recesses parallel to each other, which are located in the area of the drive roller and its counter pressure roller, and preferably the input drive roller and its counter pressure roller. Thereby, both the drive roller and its counter pressure roller and preferably the input drive roller and its counter pressure roller are structured.

In another embodiment, the top member of the band channel has the plurality of recesses and the counter pressure rollers are structured, while the bottom member has only a single wide recess through which the unstructured drive rollers can act on the band.

The structured rollers are in particular several grooves running parallel to each other and circumferentially, the width of which is only slightly greater than the webs separating the recesses in the bottom component or in the cover component. The plane spanned by one of the grooves is preferably perpendicular to the axis of the roll.

In a preferred embodiment, the structuring of the drive roller(s) and/or their counter pressure rollers is determined by the bearing areas adapted to the different band widths. In this preferred embodiment, the exceptions of the bottom component are also selected accordingly.

In a preferred embodiment of a band drive of the second type, the counter pressure rollers to the drive roller as well as, if applicable, to the input drive roller and the counter pressure wheel to the encoder wheel are mounted on a lever mechanism. The lever mechanism allows the counter pressure rollers and, if necessary, the counter pressure wheel to be raised slightly to allow the band channel to be pulled out or pushed in, preferably through the band insertion opening.

Since in a second type of band drive the entire band channel is replaceable, a holder which is fixedly mounted in the machine helps to hold the band channel in the operating position. The band channel is then inserted into such a holder during replacement. This holder should preferably ensure that the band channel is in the correct position relative to the drive roller in the operating position. Furthermore, the holder can also support the input drive roller and the encoder wheel. Such a holder represents a quasi interface between the active parts of the band drive equipped with motors and sensors, and consequently connected to the power supply and the control system, and the replaceable, preferably passive, parts.

The drive rollers accelerate and brake the band by pressing it against a resistance. This is preferably a counter pressure roller, but it can also be a wall of the band channel.

If counter pressure rollers and possibly a counter pressure wheel are attached to the band channel, or if the band channel itself serves as a counter pressure surface, the holder should preferably press the band channel against the drive rollers so that it can perform this very counter pressure function.

Alternatively, the holder can also hold counter pressure rollers and, if necessary, the counter pressure wheel, and the band channel can serve solely to guide the band. Since the band channel is higher than the thickness of the band and thus also higher than the distance between the counter pressure roller and the drive roller in the operating state, the distance between the rollers can preferably be increased for the insertion of the band channel. A preferred lever mechanism allows such lifting of the counter pressure rollers and, if necessary, of the counter pressure wheel conveniently and with only one hand. This leaves the user with his second hand to push in or pull out the band channel.

In a particularly preferred embodiment, if the lever mechanism is preloaded, the counter pressure roller and, if applicable, the counter pressure wheel can be pressed against the drive roller and, if applicable, input drive roller and the encoder wheel with a desired pressure when the lever is not actuated. Thus, this part of the drive automatically adjusts to the band thickness.

In a preferred embodiment of a second type of band drive, the band channel is secured in its operating position with a clamp that can be detached and attached without tools.

Particularly preferably, it is secured with a single clamp.

With a single clamp, which is preferably U-shaped and is pushed onto the band channel directly behind the holder and secured there with a screw or a pretensioned pin, it can be prevented that the band channel slides out of the banderoling machine against the band feed direction. Sliding in too far is usually prevented by gravity. In addition, however, the band channel can preferably be provided with a stop that prevents it from being pushed in too far by contact with the holder.

In a preferred embodiment, the lever mechanism of the holder carries a pin which engages in a corresponding recess at the edge of the band channel and secures the band channel against slipping in this way.

In a preferred embodiment, a band drive of the first type is provided with a lever mechanism which raises either pressure surfaces or counter pressure rollers and, if necessary, a counter pressure wheel relative to the bottom component and allows one or more side components to be inserted and then subsequently fixes the side components relative to the bottom component.

In a preferred embodiment of a band drive of the second type, its one channel side wall, channel top and channel bottom are substantially interrupted in the region of the drive roller, so that the band channel can be inserted laterally into the holder.

From the following detailed description and the totality of the patent claims, further advantageous embodiments and combinations of features of the invention will be apparent.

BRIEF DESCRIPTION OF THE ACCOMPANYING DRAWINGS

The drawings used to explain the embodiment show:

FIG. 7 is a view of a band drive roller with supporting surfaces and their position on a wide and the narrowest band;

FIG. 8 is a view of a band drive of the first type for a banderoling machine in which the position of the first longitudinal side of the band channel is the same for all band widths;

FIGS. 9A, 9B and 9C are views showing components of a band drive of the first type according to FIG. 8 for a narrow band;

FIGS. 10A, 10B and 10C are views showing components of a band drive of the first type according to FIG. 8 for a wide band;

FIGS. 11A and 11B is a view of a component of a band drive of the first type according to FIG. 8;

FIGS. 12A and 12B are views of a cross-section through the band channel of a band drive of the first type according to FIG. 8 for a narrow and a wide band;

FIG. 13 is a view of a band drive of first type;

FIGS. 14A, 14B and 14C are views showing side components of a band drive of the first type according to FIG. 13 for a narrow band;

FIGS. 15A, 15B and 15C are views showing side components of a band drive of the first type according to FIG. 13 for a wide band;

FIGS. 16A and 16B are view showing a bottom component of a band drive of the first type according to FIG. 13;

FIGS. 17A and 17B are views of a cross-section through the band channel of a band drive of the first type according to FIG. 13 for a narrow and a wide band;

DETAILED DESCRIPTION OF THE PREFERRED EMBODIMENTS

WAYS OF CARRYING OUT THE INVENTION

Figure 1:
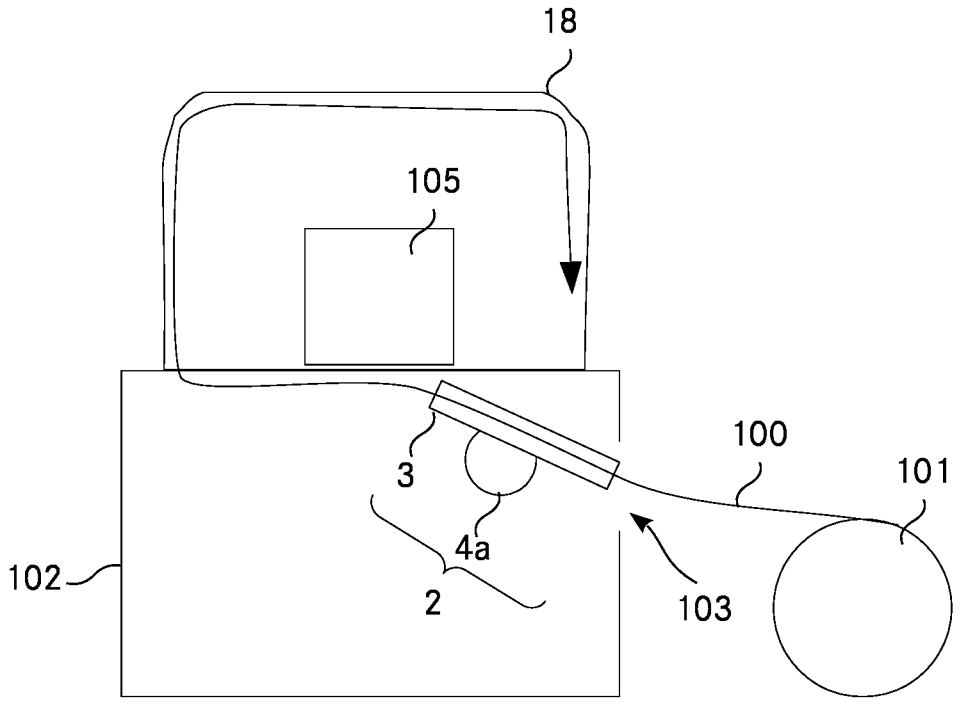
FIG. 1 is a view or sketch of a banderoling machine.

FIG. 1 shows a sketch of a banderoling machine 1 with a curved guide 18, by means of which a band 100 is placed around an object 105. The curved guide 18 is mounted on a housing 102. In the housing 102, there is a band drive 2 with the aid of which the band 100 is shot into the curved guide 18. The band 100 is injected to such an extent that it ultimately overlaps with itself. The beginning of the band 100 is held in this overlapping area, which is located below the object 105 in the sketch. Then the band drive 2 runs backwards, pulling the band 100 back and tightening it. As it does so, the band 100 leaves the curved guide 18 and wraps around the object 105. Once a desired length or tension is reached, the band 100 is joined to itself, for example by an ultrasonic welding process. The band 100 is cut and the band 100 in the band drive 2 is re-fed into the curved guide 18 for banderoling the next object 105. The band 100 is taken from a supply roll 101 and guided through a band insertion opening 103 to the, inside the housing 102, band drive 2.

The band drive 2 comprises, on the one hand, a band channel 3 which guides the band 100 and, on the other hand, a drive roller 4*a* which accelerates the band 100. As a rule, the infeed and the retraction of the band 100 are carried out with the aid of the same drive roller 4*a*. However, it is also possible to use two rollers, each of which can be driven in one direction and run freely in the opposite direction.

Figure 2:
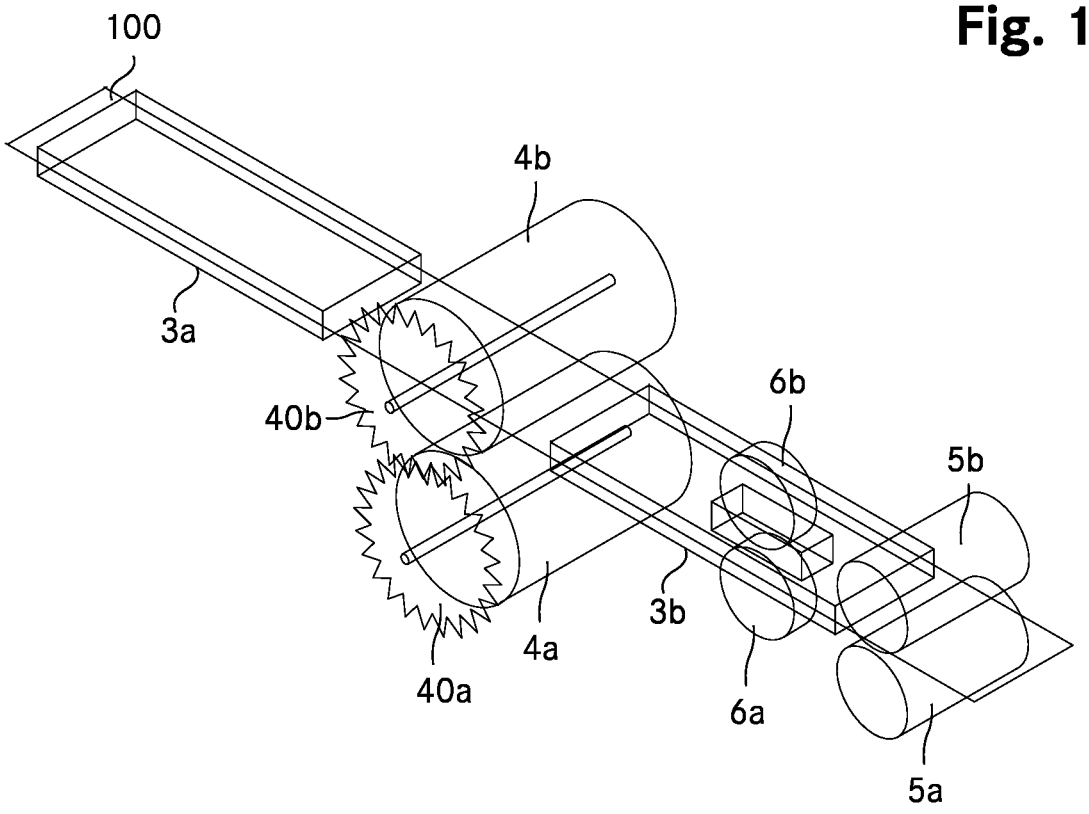
FIG. 2 is a schematic view of a structure of a band drive.

FIG. 2 shows the schematic structure of a band drive 2. Here, the band channel 3 consists of two parts: A front part 3*b* and a rear part 3*a*. The band 100 runs in this band channel 3. The drive roller 4*a* is arranged between the front part 3*b* and the rear part 3*a* of the band channel 3. In the example shown, the drive roller 4*a* presses the band 100 against a counter pressure roller 4*b*. The drive roller 4*a* and the counter pressure roller 4*b* each run on an axle which also carries a gear wheel 40*a*, 40*b*. The gear wheels 40*a*, 40*b* mesh with each other in the operating state. The drive roller 4*a* is driven by a motor not shown. The counter pressure roller 4*b* is coupled to the drive roller 4*a* by the gear wheels 40*a*, 40*b* and is thus also driven. The band 100 is clamped between the two rollers and can thus be accelerated. It has proved advantageous to manufacture the drive roller 4*a* from aluminum and to coat the counter pressure roller 4*b* with rubber. In this way, good power transmission to the band 100 can occur and the machine can be easily maintained.

In order to simplify the threading of the band 100 at the beginning of operation and to reduce the risk of a band jam in the band channel 3, the band drive 2 can have an input drive roller 5*a*. This may be driven by the same motor as the drive roller 4*a*. Here, too, the band 100 is pressed on with the aid of a counter pressure roller 5*b*. The combination of a driven aluminum roll as input drive roll 5*a* and a counter pressure roll 5*b* made of rubber has also proved successful here. Although it is possible in principle to couple the counter pressure roller 5*b* and the input drive roller 5*a*, this was not done here.

To determine the length of the injected and retracted band 100, an encoder wheel 6*a* is used in the example shown. For reliable measurement, there should be as little slip as possible between band 100 and encoder wheel 6*a*. This is achieved by using a counter pressure wheel 6*b*.

In the example of FIG. 2, the band channel 3 is interrupted in the area of the drive roller 4*a* and does not begin until after the input drive roller 5*a*. For the encoder wheel 6*a* and the counter pressure wheel 6*b*, the band channel 3 has a recess in the bottom component and the ceiling component.

Figure 3:
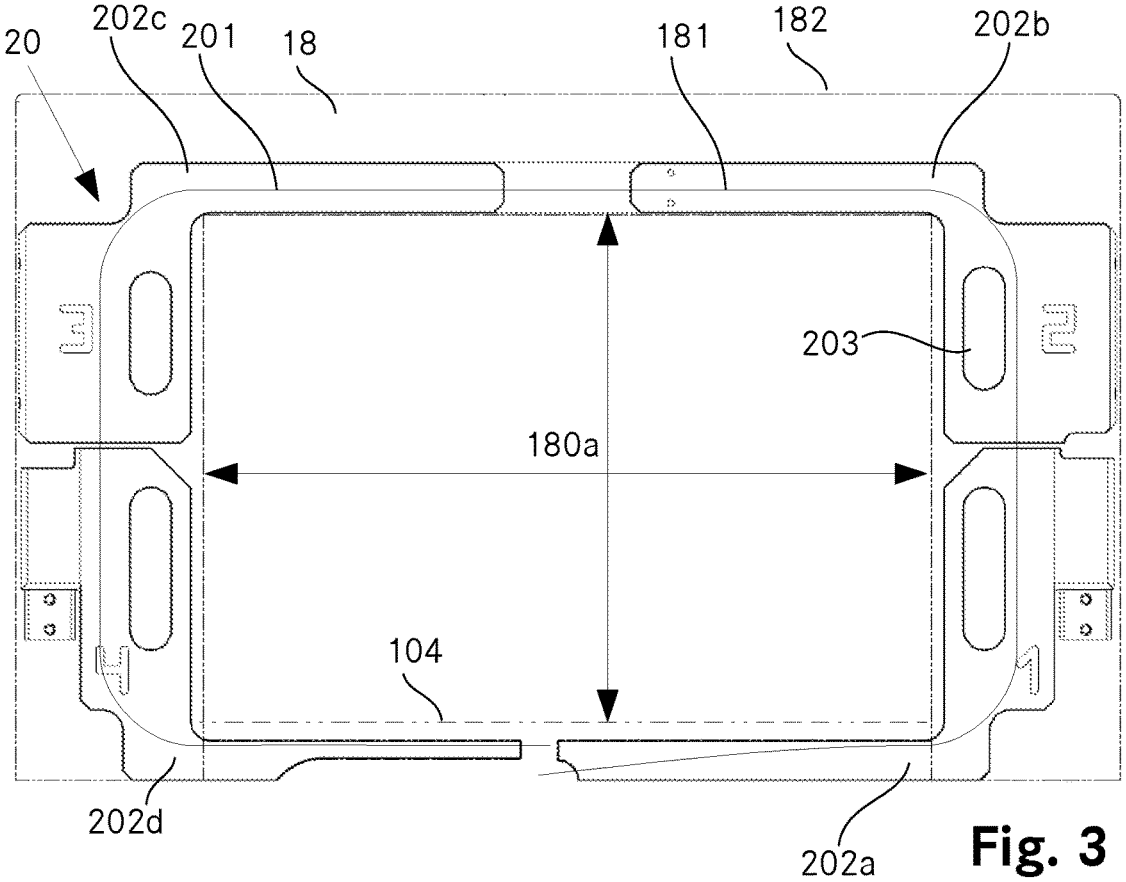
FIG. 3 is a view showing a curved guide with an inserted insert consisting of four parts, viewed from the front.

FIG. 3 shows a curved guide 18 with an inserted insert 20 as seen from the front. The insert 20 consists of four parts 202*a*, 202*b*, 202*c*, 202*d*. The curved guide 18 includes a cover 182 and a band guiding surface 181. The curved guide 18 is part of a banderoling machine that also includes a table 104. The goods to be banded are placed on the table 104 during banderoling, and the band guiding surface 181 guides the band 100 around the goods. The surface of the table 104 is therefore just above the band guiding surface 181 and restricts the clear opening 180*a* of the curved guide 18. Otherwise, in the example shown, the cover 182 restricts the clear opening 180*a*.

The insert 20 is arranged to provide a restriction surface 201 for the band guiding surface 181. The restriction surface 201 is interrupted over short distances on the straight sections to facilitate insertion of the insert 20.

Each of the portions or parts 202*a*, 202*b*, 202*c* and 202*d* of the insert 20 is provided with a handle recess 203. These handle recesses 203 are located outside the clear opening 180*a* of the curved guide 18 but inside the clear opening of the band guiding surface. They can therefore be gripped by the user, but at the same time do not restrict the size of the goods to be banded.

Figure 4A:
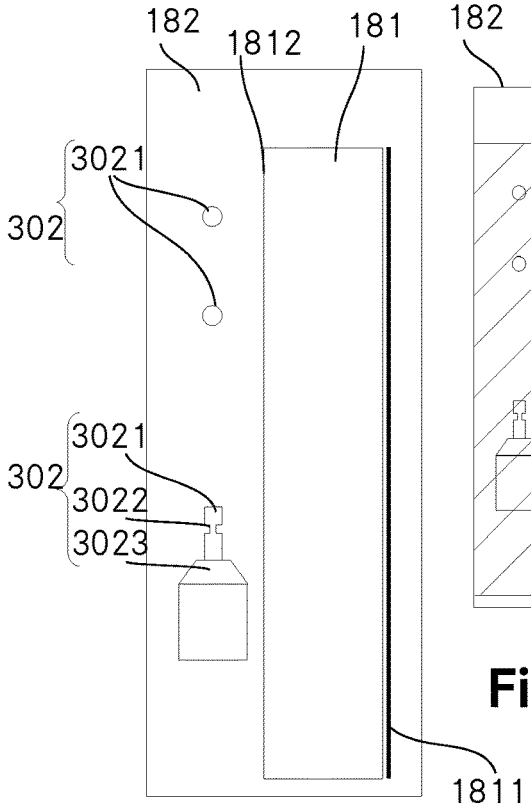
FIG. 4A is a view showing a curved guide with second halves of two latching systems in a sectional view, with the viewing direction perpendicular to the band guiding surface.

FIG. 4A shows a curved guide with second halves 302 of two latching systems 30 in a sectional view. The direction of view is perpendicular to the band guiding surface 181. In this view, the band guiding surface 181 appears extended as an elongated rectangle. The band guiding surface 181 is restricted on the first side 1811, for example by a board. This restriction prevents the band 100 from slipping off the band guiding surface 181 beyond the first side 1811. On the second side 1812, the band guiding surface 181 is unrestricted, allowing the band 100 to overhang there.

The band guiding surface 181 shown is a portion of the arc shown in FIG. 3, and it continues above and below, projecting from the plane of the image. The band guiding surface 181 is surrounded by the cover 182. The cover 182 is open to the interior of the curved guide 18. Two second halves 302 of latching systems 30 (shown in FIG. 6) are mounted on the inner surface of the outer side of the cover 182.

The upper second half 302 of a latching system 30 comprises two socket pins 3021 mounted parallel to each other on the inner surface of the outer side of the cover 182. The two socket pins 3021 extend perpendicularly from this inner surface. In the view shown, they therefore appear as circles.

The lower second half 302 of a latching system 30 comprises a socket pin 3021 mounted on a region 3023 on the curved guide 18, which is not rotationally symmetrical in the strict sense. In the present case, the region 3023 is shaped as a section of a square pyramid. The socket pin 3021 has a groove 3022. The socket pin 3021 extends parallel to the inner surface of the outer surface of the cover 182.

Both of the second halves 302 of the latching systems 30 shown here are examples of anti-rotation fastening systems.

Figure 4B:
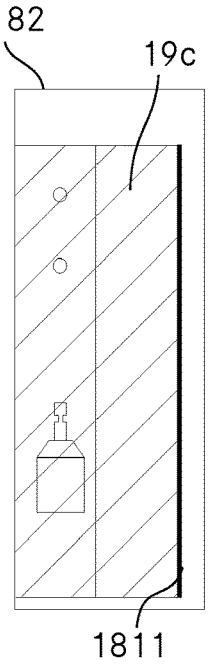
FIG. 4B is a view showing a curved guide as shown in FIG. 4A, with the widest band to which the banderoling machine can be adapted also inserted.
Figure 4C:
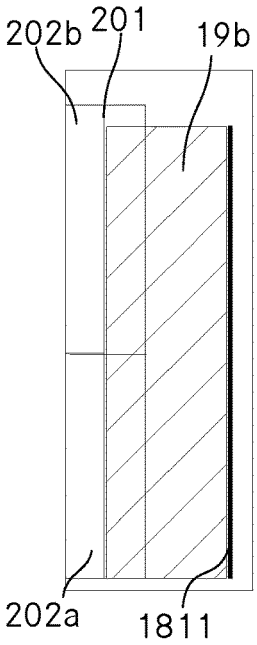
FIG. 4C is a view showing a curved guide according to FIG. 4A, whereby a multi-part insert is also inserted in order to adapt the banderoling machine to a medium-width band also shown.
Figure 4D:
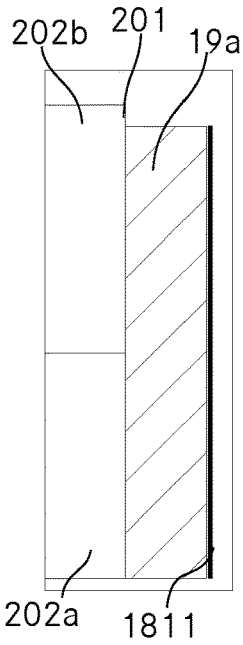
FIG. 4D is a view showing a curved guide as shown in FIG. 4A, where a multi-part insert is also used to adapt the banderoling machine to the narrowest band also shown.

FIGS. 4B, 4C and 4D illustrate how bands 19*a*, 19*b* and 19*c* of different widths are guided in the curved guide 18 shown in FIG. 4A.

FIG. 4B shows the situation with the widest band 19*c* that can be processed by the banderoling machine shown. The band 19*c* is shown hatched but transparent: This band 19*c* is guided at its first edge by the restricted first side 1811 of the band guiding surface 181 and is prevented from slipping off at its second edge by the cover 182. The curved guide 18 is similar to that shown in FIG. 4A.

FIG. 4C shows the situation with a band 19*b* of medium width. In order to guide this band 19*b* securely, a multi-part insert 20 is used in the example shown: an upper part 202*b* uses the upper latching system 30. The lower part 202*a* uses the lower latching system 30. The parts 202*a* and 202*b* of the insert 20 have a step: one surface continues the band guiding surface 181, and a surface perpendicular to it represents the restriction surface 201. The distance between the restriction at the first side 1811 of the band guiding surface 181 and the restriction surface 201 is adapted to the width of the band 19*b*. Thus, the band 19*b* cannot slip or kink in any direction.

FIG. 4D shows the situation with the narrowest band 19*a* that can be used in the curved guide 18 shown. In order to guide this band 19*b* safely, a multi-part insert 20 is also used in the example shown: The upper portion 202*b* utilizes the upper latching system 30, and the lower portion 202*a* utilizes the lower latching system 30. The portions 202*a* and 202*b* of the insert 20 are substantially plate-shaped, and project sufficiently toward the interior of the curved guide to restrict the band guiding surface 181 on its second side 1812, thereby forming the restriction surface 201. The distance between the restriction on the first side 1811 of the band guiding surface 181 and the restriction surface 201 is adapted to the width of the band 19*a* and just corresponds to the width of the band guiding surface 181. Thus, the band 19*a* cannot slip or kink in any direction.

Figure 5A:
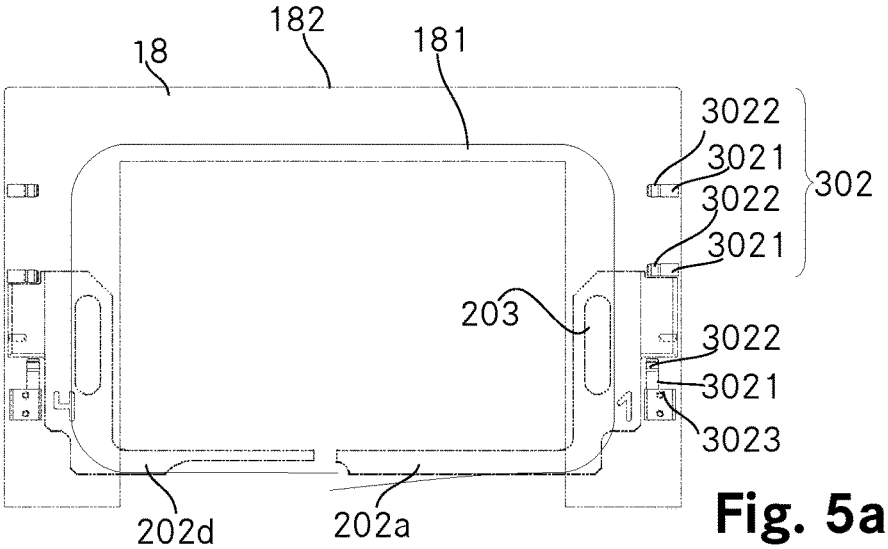
FIGS. 5A and 5B are views showing the curved guide according to FIG. 3 during insertion of the parts of the insert.
Figure 5B:
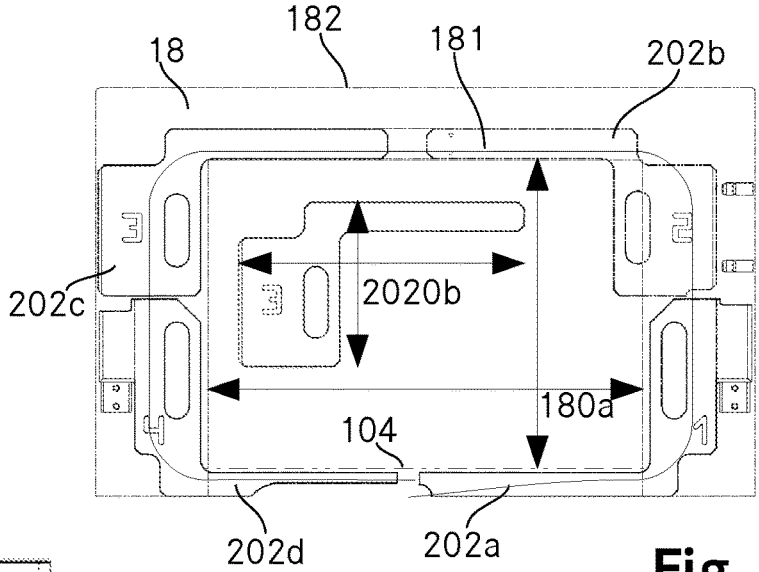

FIGS. 5A and 5B illustrate how the insert 20 according to FIG. 3 is inserted into the curved guide 18. In FIG. 5A, the lower two parts 202*a* and 202*d* are inserted: These are inserted into the cover 182 from the inside and can then, along the inner surface of the outer side, be slid downwards onto the second half 302 of the latching system 30 and thus be fixed against rotation. For this purpose, the two lower parts 202*a* and 202*d* are equipped with a first half 301 of the latching system 30, which is not visible in this view. FIG. 5A shows the situation before engagement, so that the parts 202*a* and 202*d* are still above their operating position and therefore only restrict the band guiding surface 181 over short distances.

FIG. 5B shows the insertion of the upper parts 202*c* and 202*a*. The part 202*c* is shown twice in the figure: on the one hand, it is already in its operating position and fixed by the upper latching system 30, on the cover 182 of the band guiding surface 181. On the other hand, it is drawn inside the clear opening 180*a* of the curved guide 18: The outer dimensions 2020*b* of the part 202*c* of the insert 20 are smaller than the clear opening 180*a* of the curved guide 18, so that the part 202*c*, as well as the other parts of the insert 20, can be conveniently brought from the inside to the inner surface of the outer side of the cover 182 and fixed there. In this example, the latching system 30 with which the upper parts 202*b* and 202*c* are fastened is designed differently from that of the lower parts 202*a* and 202*d*: it comprises two socket pins projecting perpendicularly from the inner surface of the outer side of the cover 182, onto which the upper parts 202*b* and 202*c*, each having a first half 301 of the latching system 30 consisting of two blind holes 3011 are pushed.

Figure 6:
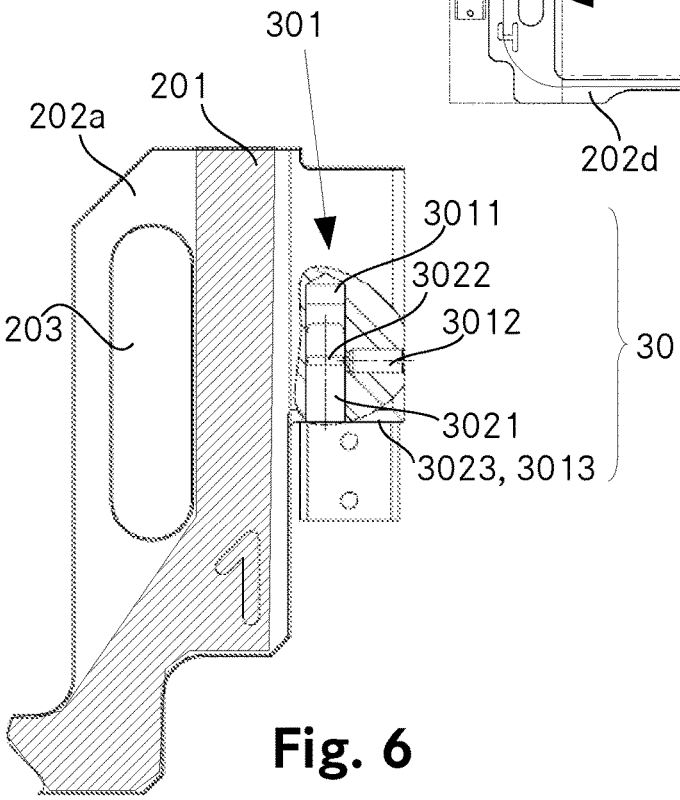
FIG. 6 is a view of a latching connection in detail.

FIG. 6 shows the latching system 30 in detail, with which the lower parts 202*a* and 202*d* are fastened to the cover 182 in the embodiment according to FIG. 3 and FIGS. 5A and 5B. The attachment to the cover 182 of the band guide 18 is cuboidal in shape and merges at the upper end into a region 3023, the shape of which corresponds to a section of a square pyramid. A socket pin 3021 is attached to this area 3023. This socket pin 3021 is provided with a groove 3022. The area 3023, which is not rotationally symmetrical in the strict sense, and the socket pin 3021 with its groove 3022 constitute the second half 302 of a latching system 30. This second half 302 of the latching system 30 is attached to the curved guide 18.

The corresponding first half 301 of the latching system 30 is formed in the fastening part 202*a* of the insert 20. It is a blind hole 3011 provided with a resilient thrust piece 3012. The blind hole 3011 is formed in an area 3013, of the part

202*a* of the insert 20, which is shaped complementary to the area 3023 of the second half 302 of the latching system.

When the two halves of the latching system 30 are engaged, the tip of the resilient thrust piece 3012 rests in the groove 3022 and thus, together with the regions 3013 and 3023 resting on each other, prevents relative movement in the direction of expansion of the blind hole 3011 and the insertion bolt 3012. The interaction of the blind hole 3011 and the socket pin 3012 prevent relative translational movement perpendicular to the direction of expansion of the blind hole 3011 and the socket pin 3012. Finally, the shape of the complementary shaped portions 3013 and 3023 also prevents relative rotational movement about the direction of expansion of the blind hole 3011 and the socket pin 3012. Thus, the part 202*a* is securely and non-rotationally fastened by the snap-fit connection without the need for a tool to make or break the connection.

In FIG. 6, the area of the part 202*a* that can serve as a restriction surface 201 is also indicated by hatching. FIG. 6 shows a plate-shaped part 202*a* of an insert 20 which does not continue the band guiding surface 181 but only restricts it. In an embodiment in which the part 202*a* continues the band guiding surface 181, the step is found within the hatched area, one side of which continues the band guiding surface 181 while the other side restricts the band guiding surface 181 and thus forms the restriction surface 201.

FIG. 7 shows a counter pressure roller 4*b* to a band drive roller with bearing surfaces 41*a* and 41*b*. Also shown is the counter pressure wheel 6*a* to the encoder wheel. FIG. 7 illustrates the design and arrangement using the example of the narrowest band 19*a* and a wider band 19*b* that the banderoling machine can handle. The arrangement shown in FIG. 7 is preferably used in embodiments in which the position of the first edge of bands of all widths is the same relative to the band drive. In this case, unlike in FIGS. 13 to 17 which follow later, the bands do not run centered in the band drive, but along the first side of the band drive.

In this embodiment, the encoder wheel and the counter pressure wheel to the encoder wheel 6*a* are positioned near the first edge of the bands or the first side of the band drive in such a way that they are still in full contact even with the narrowest band 19*a*. This means that the encoder wheel 6*s* and the counter pressure wheel for the encoder wheel 6*a* are in a range in which they are fully in contact with the width of each of the possible bands and can therefore provide reliable measured values.

The band drive roller should be able to act as symmetrically as possible on each of the possible bands in order to ensure uniform and symmetrical insertion. This requirement can be achieved by a band drive roller and/or a counter pressure roller 4*b* to the band drive roller with bearing surfaces 41*a*, 41 *b*. In fact, it has been found that interruptions in the contact with the band drive roller 4*a* in the center of the band have hardly any influence on the uniformity of the insertion if only the edges of the band are accelerated equally. The supporting surfaces 41*a* are therefore dimensioned in such a way that the distance 42*a* between the first edge of the band and the first side of the first supporting surface 41*a*, i.e. the width of the free surface on the first side, is equal to the distance 42*b* between the second edge of the band and the second side of the supporting surface nearest to the second edge of the band and running on the band, i.e. the width of the free surface on the second side. The support surface nearest the second edge of the band and running on the band is the support surface 41*a* for the narrowest band 19*a* and the support surface 41*b* for the wider band 19*b*.

FIG. 8 shows the band channel 3 of a band drive of the first type, in which the bands of different widths are guided in such a way that the first edge is located at the same position in the band drive for bands of all band widths. A front and a rear side member, 8*a* and 8*b*, form the channel top and the channel side walls. The channel bottom is formed by a bottom component 7. The band channel 3 has a recess in the area of the drive roller and its counter pressure roller, both of which are not shown, both in the channel bottom and in the channel ceiling. At this point, the front and rear side components 8*a* and 8*b* abut each other. Both side components 8*a*, 8*b* near the drive roller are flattened in order to guide the band as far as possible into the space between the two rollers.

On the front side component 8*a*, the counter pressure wheel 6*b* to the encoder wheel is mounted in a recess in the channel cover. The counter pressure wheel 6*b* is slightly offset towards the first side in order to rest completely on even the narrowest band. At the front end of the front side component 8*a*, the counter pressure roller 5*b* is also mounted to the input drive roller 5*a*. The counter pressure roller 5*b* is a rubber roller structured to have as many parallel bearing surfaces as there are different widths of bands for the banderoling machines. Two bearing surfaces are shown here, separated by a groove.

On the rear side component 8*b* there is a laterally projecting handle 80.

The side components 8*a* and 8*b* are held to the bottom component 7 by three clamps 11*a*, 11 *b* and 11*c*. The clamps 11*a*, 11 *b*, 11*c* are U-shaped in design and are slid laterally into grooves on the top of the side components 8*a* and 8*b* and into a guide of the bottom component 7 and are secured by hand-tightenable screws.

In order to adapt the first type of band drive to the width and thickness of a band, the securing screws of the clamps 11*a*, 11*b*, 11*c* are first loosened and the clamps 11*a*, 11*b*, 11*c* are pulled off. Then the front side component 8*a* can be pulled out to the front, through the band insertion opening. At the handle 80, the rear side component 8*b* can then be lifted slightly and then pulled out sideways. Then the side components 8*a* and 8*b* adapted to the band are inserted in reverse order and secured with the aid of the clamps 11*a*, 11*b* and 11*c*.

FIGS. 9A, 9B and 9C show the side components of the band drive according to FIG. 8 for a narrow band. FIG. 9A shows the front side component 8*a* from below. The counter pressure roller 5*b* is mounted at the front end. Adjacent to this is the essentially flat underside of the side component 8*a*. The underside has the shape of a rectangle with a width corresponding to the width of the bottom component 7 and a length corresponding to the distance between the input drive roller 5*a* and the drive roller. To the right and left of the location where the counter pressure roller of the drive roller is to engage, the bottom side continues a little further. The front side component 8*a* is provided at one point with a recess in which the counterpressure wheel 6*b* is mounted.

The flat surface of the underside is structured as follows: A first protrusion having a first height extends along the outer, long edges. The first height corresponds to the height of the desired inner cross-section of the band channel. Adjacent to this first protrusion on the inside and also extending along the entire length are second protrusions with a second height. This combination of first and second protrusions interacts with the corresponding edge step (10*c*1, 10*c*2 FIG. 11A).

Parallel to these second protrusions and also extending along the entire length is a third protrusion, which is the second channel sidewall forming section 9. It also has the second height. The third protrusion and the second protrusion on the first side of the side member constitute the channel sidewall forming sections 9. They are spaced apart by a distance equal to the width of the desired inner cross-section of the band channel. The section of the flat surface of the underside between the two sections 9 forming the channel side walls forms the channel ceiling in the assembled state.

The second height as well as the width of the projections are selected in such a way that they can engage in the corresponding notch 10*d* and the edge steps 10*c*1, 10*c*2 of the bottom component 7 and, in particular, in such a way that the first projection can rest on the bottom component 7.

FIG. 9B shows the rear side component 8*b*, which belongs to the front side component 8*a* of FIG. 9A. The underside is also shown. This underside is also a substantially flat surface with first, second and third projections corresponding in arrangement, height and width to those of the front side component 8*a*. The underside of the rear side component 8*b* is also substantially rectangular with a width corresponding to the width of the bottom component 7 and a length corresponding to the distance between the drive roller and the rear end of the bottom component 7. On the side facing the drive roller, the rear side member 8*b* extends a little further in a central region, so that when the rear side member 8*b* and the front side member 8*a* are arranged in their operating position on the bottom member 7, a portion of the rear side member 8*b* is surrounded on the right and left by portions of the front side member 8*a*, and a recess remains between the two side members 8*a* and 8*b* in which the counter pressure roller 5*b* can engage with the drive roller.

FIG. 9C shows a cross-section through a side component 8 according to one of FIG. 9A or 9B: First, second and third projections pointing downward are attached to a rectangular basic shape. The first projections are on the right and left outside and have a first height which is smaller than the second height of the second and third projections. The second projections are arranged directly adjacent to the first projections. The third protrusion and the second protrusion on the first side represent the channel sidewall forming portions 9 of the side member 8.

FIGS. 10A-10C show the side components 8 of the band drive according to FIG. 8 for a wide band. They are similar to FIGS. 9A-9C except that there are no third projections, but the second projections represent the channel side wall forming portions 9 of the side member 8. The facing sides of the sections 9 forming the channel side walls are spaced apart by a distance corresponding to the width of the desired inner cross-section of the band channel. The width is obviously greater than in the case of the side members according to FIGS. 9A-9C.

In order to match the height of the inner cross-section of the band channel, the height of the projections is selected to be correspondingly adapted. In order not to have to replace clamps and possibly other fastening elements when adapting to the thickness of a band, the rectangular basic shape shown in FIGS. 9C and 10C can be adapted in such a way that the sum of the height of the first projections and the height of the basic shape is the same for all side components.

FIGS. 11A and 11B show the bottom component 7 of the band drive according to FIG. 8. FIG. 11A shows a top view of the bottom component 7. The bottom component 7 also has an essentially flat, rectangular shape. At the front end, in this embodiment, the input drive roller 5*a* is mounted. There are also recesses for the encoder wheel and the drive roller. The plane of the bottom component 7 is provided with two edge steps 10*c*1 and 10*c*2 and a notch 10*d* extending along its entire length. The edge step 10*c*1 runs along the first side of the bottom component 7. The edge step 10*c*1 runs along the second side of the bottom component 7. The distance of the inner sides of the edge step 10*c*1 on the first side of the bottom component 7 to the side of the notch 10*d* facing it, corresponds to the width of the inner cross section of the band channel desired for a certain band width. The notch 10*d* can receive the third projection of the side member according to FIGS. 9A-9C and the edge steps 10*c*1, 10*c*2 can receive the first and second projections of the side member according to FIGS. 9A-9C and FIGS. 10A-10C.

FIG. 11B shows a cross-section through the bottom component 7 according to FIG. 11A with the notch 10*d* and the two edge steps 10*c*1 and 10*c*2.

FIGS. 12A and 12B show the cross-sections through the band channel when once the side components 8 for narrow bands according to FIGS. 9A-9C and once the side components 8 for wide bands according to FIGS. 10A-10C are used: Thanks to the notch 10*d* and the edge steps 10*c*1, 10*c*2 and projections 9, the transition between the bottom component and the side components is always below the channel bottom. This means that the guided band does not run along a gap between the two components and can hardly jam. The edge steps 10*c*1, 10*c*2 and projections 9 also align the band channel correctly, so that the necessary precision in the order of 0.1 mm is achieved without measuring and adjusting when replacing the side components 8. If required, further notches and corresponding side components can be designed analogously to the examples shown. Adaptation to different band thicknesses is achieved by appropriate selection of the height of the projections.

FIG. 13 shows the band channel 3 of a band drive of the first type, in which bands of different widths are guided in a centered manner. A front and a rear side member, 8*a* and 8*b*, form the channel top and the channel side walls. The channel bottom is formed by a bottom component 7. The band channel 3 has a recess in the area of the drive roller and its counter pressure roller, both of which are not shown, both in the channel bottom and in the channel ceiling. At this point, the front and rear side components 8*a* and 8*b* abut each other. Both side components 8*a*, 8*b* near the drive roller are flattened in order to guide the band as far as possible into the space between the two rollers.

At the front side component 8*a*, the counter pressure wheel 6*b* to the encoder wheel is mounted in a recess in the channel cover. At the front end of the front side component 8*a*, the counter pressure roller 5*b* to the input drive roller 5*a* is also mounted. The counter pressure roller 5*b* is a rubber roller structured to have two parallel running surfaces separated by a centrally extending groove.

A laterally projecting handle 80 is located on the rear side component 8*b*.

The side components 8*a* and 8*b* are held to the bottom component 7 by three clamps 11*a*, 11 *b* and 11*c*. The clamps 11*a*, 11 *b*, 11*c* are U-shaped in design and are slid laterally into grooves on the top of the side components 8*a* and 8*b* and into a guide of the bottom component 7 and are secured by hand-tightenable screws.

In order to adapt the first type of band drive to the width and thickness of a band, the securing screws of the clamps 11*a*, 11 *b*, 11*c* are first loosened and the clamps are pulled off. Then the front side component 8*a* can be pulled out to the front, through the band insertion opening. At the handle 80, the rear side component 8*b* can then be lifted slightly and then pulled out sideways. Then the side components 8*a* and

8*b* adapted to the band are inserted in reverse order and secured by means of the clamps 11*a*, 11*b* and 11*c*.

FIGS. 14A, 14B and 14C show the side components of the band drive according to FIG. 13 for a narrow band. FIG. 14 shows the front side component 8*a* from below. The counter pressure roller 5*b* is mounted at the front end. Adjacent to this is the essentially flat underside of the side component 8*a*. The underside has the shape of a rectangle with a width corresponding to the width of the bottom component 7 and a length corresponding to the distance between the input drive roller 5*a* and the drive roller. To the right and left of the location where the counter pressure roller of the drive roller is to engage, the bottom surface continues a little further. The front side component 8*a* is provided at one point with a recess in which the counter pressure wheel 6*b* is mounted.

The flat surface of the underside is structured as follows: A first protrusion having a first height extends along the outer, long edges. The first height corresponds to the height of the desired inner cross-section of the band channel. Adjacent to this first protrusion on the inside and also extending along the entire length are second protrusions with a second height. Parallel to these second protrusions and also extending along the entire length are third protrusions forming channel sidewall sections 9. They have a third height. The facing sides of the sections 9 forming the channel side walls are spaced apart by a distance equal to the width of the desired inner cross-section of the band channel. The section of the flat surface of the underside between the two sections 9 forming the channel side walls forms the channel ceiling in the assembled state.

The second and the third heights as well as the width of the projections are selected in such a way that they can engage in corresponding notches of the bottom component 7 and, in particular, in such a way that the first projection can rest on the bottom component 7.

FIG. 14B shows the rear side component 8*b*, which belongs to the front side component 8*a* of FIG. 14A. The underside is also shown. This underside is also a substantially flat surface with first, second and third projections corresponding in arrangement, height and width to those of the front side component 8*a*. The underside of the rear side component 8*b* is also substantially rectangular with a width corresponding to the width of the bottom component 7 and a length corresponding to the distance between the drive roller and the rear end of the bottom component 7. On the side facing the drive roller, the rear side member 8*b* extends a little further in a central region, so that when the rear side member 8*b* and the front side member 8*a* are arranged in their operating position on the bottom member 7, a portion of the rear side member 8*b* is surrounded on the right and left by portions of the front side member 8*a*, and a recess remains between the two side members 8*a* and 8*b* in which the counter pressure roller can engage the drive roller.

FIG. 14C shows a cross-section through a side component 8 according to one of FIG. 14A or 14B: First, second and third projections pointing downward are attached to a rectangular basic shape. The first projections are on the right and left outside and have a first height which is smaller than the second and the third height of the second and third projections. The second projections are arranged directly adjacent to the first projections. The third projections represent portions 9 of the side member 8 forming the channel side walls.

FIGS. 15A-15C show the side components 8 of the band drive according to FIG. 13 for a wide band. They are similar to FIGS. 4A-4C except that there are no third projections, but the second projections represent the channel side wall forming portions 9 of the side member 8. The facing sides of the sections 9 forming the channel side walls are spaced apart by a distance corresponding to the width of the desired inner cross-section of the band channel. The width is obviously greater than in the case of the side components according to FIGS. 14A-14C.

In order to adapt the height of the inner cross-section of the band channel, the height of the projections is selected to be correspondingly adapted. In order not to have to replace clamps and possibly other fastening elements when adapting to the thickness of a band, the rectangular basic shape shown in FIGS. 14C and 15C can be adapted in such a way that the sum of the height of the first projections and the height of the basic shape is the same for all side components.

FIGS. 16A and 16B show the bottom component 7 of the band drive according to FIG. 13. In FIG. 16A, a top view of the bottom component 7 is shown. The bottom component 7 also has an essentially flat, rectangular shape. At the front end, in this embodiment, the input drive roller 5*b* is mounted. There are also recesses for the encoder wheel and the drive roller. The plane of the bottom component 7 is provided with two pairs of notches 10*a* and 10*b*, which are arranged symmetrically with respect to the longitudinal axis of the bottom component 7 and extend along its entire length. The distance of the inner sides belonging to each pair of notches 10*a* or 10*b* corresponds respectively to the width of the inner cross-section of the band channel desired for a given band width. The pair of notches 10*b* can accommodate the channel side wall forming sections 9 of the side member according to FIGS. 14A-14C, and the pair of notches 10*a* can accommodate the channel side wall forming sections 9 of the side member according to FIGS. 15A-15C.

FIG. 16B shows a cross-section through the bottom component 7 according to FIG. 16A with the two pairs of notches 10*a* and 10*b*.

FIGS. 17A and 17B show the cross-sections through the band channel when once the side components 8 for narrow bands according to FIGS. 14A-14C and once the side components 8 for wide bands according to FIGS. 15A-15C are used: Thanks to the notches and protrusions, the transition between the bottom component and the side components is always below the channel bottom. This means that the guided band does not run along a gap between the components and can hardly jam. The notches and projections also align the band channel correctly, so that the necessary precision in the order of 0.1 mm is achieved without measuring and adjusting when replacing the side components 8. Further notch pairs and corresponding side components can be designed if required in the same way as the examples shown. Adaptation to different band thicknesses is achieved by appropriate selection of the height of the projections.

Figure 18:
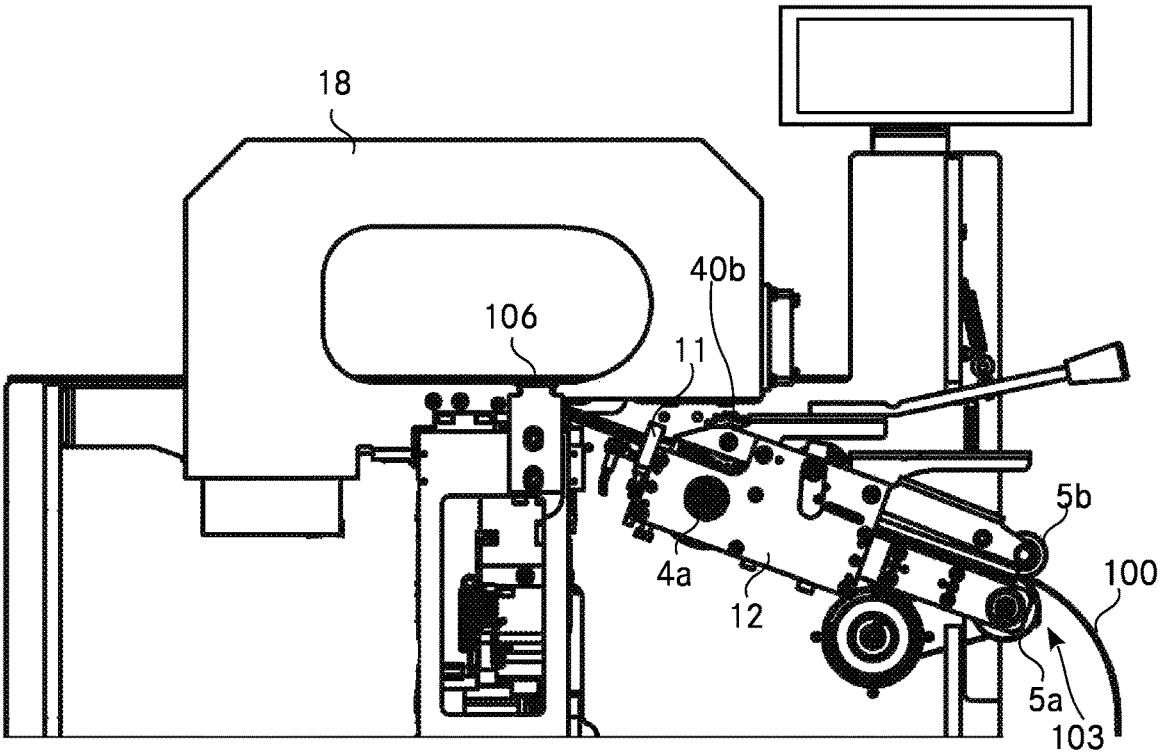
FIG. 18 is a view of a banderoling machine with a band drive of the second type.

FIG. 18 shows a banderoling machine with a second type of band drive. As already described in FIG. 1, this banderoling machine also has a curved guide 18 in which a band 100 can be guided around an object not shown. FIG. 18 now also shows the sealing unit 106 in which the beginning of the band is held after the band has been inserted and is sealed after the band 100 has been withdrawn.

In the case of a band drive of the second type, the entire band channel is exchanged in order to adapt the banderoling machines to the desired band thickness and/or width. To make this possible, the banderoling machine shown has a holder 12 which, on the one hand, can hold the band channel and, on the other hand, holds the drive roller 4*a*, the counter pressure roller 4*b* of the drive roller 4*a* and the input drive roller 5*a* and its counter pressure roller 5*b*. The drive roller

4*a* and the input drive roller 5*a* are coupled via bands to a motor that drives them. The drive roller 4*a* and its counter pressure roller 4*b* are coupled by gears. The gear wheel 40*b* of the counter pressure roller 4*b* is visible in FIG. 18.

The two counter pressure rollers 4*b* and 5*b* are mounted movably relative to the drive rollers 4*a* and 5*a* by means of a lever mechanism and can thus be raised.

The band channel is hardly visible in FIG. 18 because it is largely concealed by the holder 12. Visible, however, is a clip 11 which is attached to the band channel above the holder 12 and prevents the band channel from slipping out downward, through the band insertion opening 103.

Figure 19A:
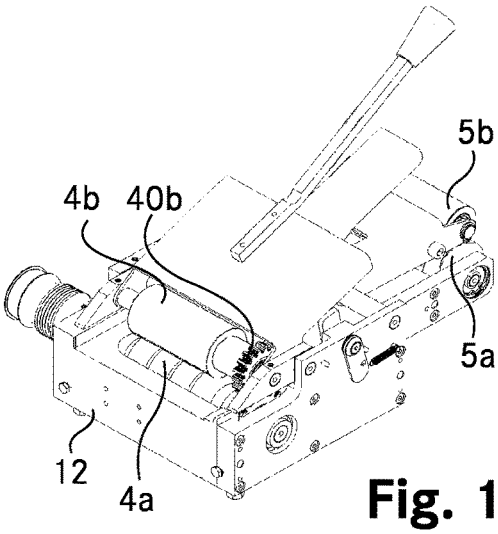
FIG. 19A shows a view of a support of a second type of band drive.

FIG. 19A shows the bracket 12 removed and in an oblique top view. In this view, the textured drive roller 4*a* and the counter pressure roller 4*b* are visible at the rear end of the holder, and the textured input drive roller 5*a* and its counter pressure roller 5*b* are visible at the front end. A lever is mounted on an axle between the two counter pressure rollers. On the same axis, the support of the counter pressure roller 4*b* of the drive roller is also supported so that it lifts when the lever is pressed down from its rest position. When the lever is pressed, the lever itself presses on a shoulder belonging to a rocker, the other end of which supports the counter pressure roller 5*b* of the input drive roller 5*a*. Pressing the lever pushes the shoulder down, and thus pushes up the counter pressure roller 5*b* of the input drive roller 5*a*. Thus, the lever pressure raises both counter pressure rollers 4*b* and 5*b* and creates space for insertion or extraction of the band channel.

The holder can also support an encoder wheel and a counter pressure wheel to the encoder wheel. Preferably, the counter pressure wheel is also attached to the lever mechanism in such a way that it is lifted by the pressure of the lever to allow the band channel to be pushed in or pulled out.

The two drive rollers 4*a* and 5*a* are each structured by three grooves running parallel to each other in such a way that four roller-shaped sections appear on the running surface of the drive rollers 4*a*, 5*a*. The drive rollers 4*a*, 5*a* are preferably made of aluminum. The counter pressure rollers 4*b*, 5*b* are preferably rubber rollers and unstructured. Their running surface is smooth.

Figure 19B:
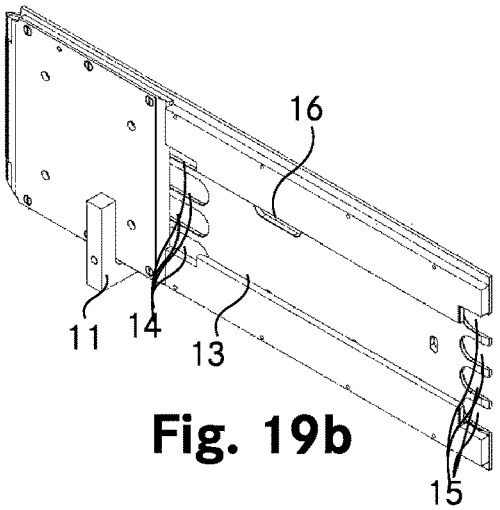
FIG. 19B shows a view of a channel of a band drive of the second type.

FIG. 19B shows a band channel 13 for a narrow band. The channel bottom of the band channel is largely continuous, the channel side walls are of substantially the same design over the entire length, and the channel top is closed in a rear section, while in the front section it has a wide recess extending over the entire length of the front section. In the area of the counter pressure rollers which delimit the front section, the recess of the channel cover is as wide as the running surface of the counter pressure rollers 4*b*, 5*b*. The channel bottom has a plurality of recesses. There are four recesses 14 in the area of the drive roller and four recesses 15 in the area of the input drive roller. The recesses 14 in the area of the drive roller are parallel to each other and are separated from each other only by narrow webs. The arrangement and width of the webs correspond to the grooves in the drive roller. The same applies to the recesses 15 in the area of the input drive roller. A single recess 16 between the area of the drive roller and the area of the input drive roller is used for contact of the band with the encoder wheel.

Figure 20A:
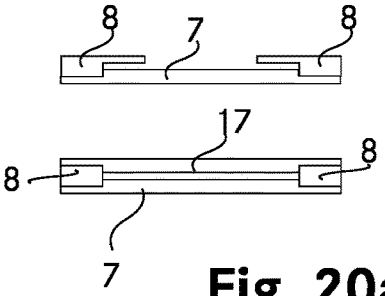
FIGS. 20A and 20B are views of a cross-section of band channels of band drives of second type for a narrow and a wide band.
Figure 20B:
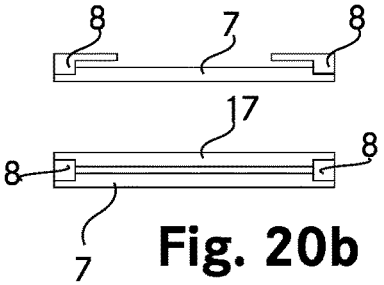

FIGS. 20A and 20B each show a cross-sectional view of the front and rear sections of a band channel 13. The band channel 13 of FIG. 20A is suitable for a narrower band than the band channel 13 of FIG. 20B. The thickness of the bands for which the two channels shown are adapted is the same.

Common to the front and rear sections in both figures is the bottom component 7: this is formed by a plate along the outer edges of each of which is a recess. The width of these recesses is determined by the width of the band for which the respective band channel is adapted: the distance between the inner edges of the recess corresponds to the desired width. The side components 8 are inserted into this recess, the foot of which has a width corresponding to that of the recess of the bottom component 7.

In the rear section, the side components 8 are bands with a rectangular cross-section whose height corresponds to the sum of the desired height of the inner cross-section of the band channel and the depths of the recesses in the bottom component 7 and the ceiling component 17. The ceiling component 17 is also realized by a plate which has recesses along its outer edges, analogous to the bottom component 7.

In the front section, the side components 8 have a slightly different shape: Their cross-section has the shape of a 90° angle, the first leg of which is as wide as the recess in the bottom component 7. These first legs are inserted into the recesses of the bottom component 7. The facing free sides of the first legs form the channel side walls. The second legs lie in one plane. Their sides facing the channel floor form the channel ceiling in the front section.

In the example shown, the band channels are made of several parts, but then they are already assembled by the manufacturer and there is no provision for the band channels to be disassembled by the user. Thus, we are dealing with one-piece banderoling channels.

To adapt a banderoling machine with a second type of band drive to a band, the clamp 11 is first released and pulled off. Then the lever is pressed and the band channel 3 is pulled out through the band insertion opening. The adapted band channel 3 is then pushed into the holder through the band insertion opening while the lever is kept pressed. When the new band channel 3 is in the operating position, it is secured there with the clamp 11.

Banderoling bands typically have a width between 25 and 100 mm and a thickness of 50-250 μm. The desired interior width, i.e. the width of the channel, is for a 25 mm band, 26 mm and for a 100 mm for example 101 mm. The interior height, i.e., the height of the channel, for a 50 μm thick band can be 0.3 mm, for example, and the interior height, i.e., the height of the channel, for a 210 μm thick band can be 0.5 mm.

In summary, encoder wheel and the input drive roller can also be omitted. In addition, the band channel according to FIG. 9 can also be designed in several parts. For example, different side components could be mounted on the same bottom component so that the height of the inner cross section of the band channel can be varied. Likewise, a band channel according to FIG. 13 can be inserted into a holder similar to the one in FIG. 19. The lever system shown in FIG. 19 could then be simplified, since the counter pressure roller of the input drive roller is supported by the band channel and not by the holder.

Instead of a multi-part insert, the insert 20 can also consist of only one part. Also, a cover may not be required if the band guiding surface is self-supporting. The band may be held to the band guiding surface in a variety of ways: for example, the band guiding surface may create a vacuum and draw the band slightly in, or the band guiding surface may be the bottom of a channel whose cover is removed in due course.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. An insert for a curved guide of a band-width-adjustable banderoling machine, which allows an adjustment of the curved guide to bands of different, desired widths, the curved guide mounted on the banderoling machine having a clear opening and outer dimensions and comprising a band guiding surface restricted on a first side and unrestricted on a second side, wherein a) the insert has a clear opening which is larger than or equal to the clear opening of the curved guide and, in the assembled state, is arranged in alignment with the clear opening of the curved guide, b) the insert has a restriction surface which, in the assembled state, is intersected by a continuation of the band guiding surface, and c) the restriction surface is configured such that, in the assembled state, a distance between the first side of the band guiding surface and the restriction surface is adapted to the desired width.

2. The insert according to claim 1, wherein a) the insert comprises a set of at least two parts, and b) the insert has the shape of an arch open on at least one straight section, i) whose outer dimension is smaller than or equal to the outer dimension of the curved guide, and c) an outer dimension of each individual part is smaller than the clear opening of the curved guide.

3. The insert according to claim 2, wherein the set of at least two parts comprises exactly four parts, each forming a corner of a substantially rectangular arc.

4. The insert according to claim 3, wherein each of the parts of the insert is equipped with a first half of a fastening system.

5. The insert according to claim 3, wherein each of the parts of the insert is provided with a handle recess.

6. The insert according to claim 2 wherein each of the parts of the insert is equipped with a first half of a fastening system.

7. The insert according to claim 2, wherein each of the parts of the insert is provided with a handle recess.

8. The insert according to claim 1, wherein a) each of the parts of the insert is equipped with a first half of a fastening system.

9. The insert according to claim 8, wherein c) the fastening system is a latching system, and d) the first half of the latching system comprises a blind hole equipped with a resilient thrust piece configured to cooperate with a socket pin with corresponding groove belonging to a second half of the latching system and mounted on the curved guide, and e) the latching system enables a twist-proof fastening by the latching system comprising:

i) either two or more blind holes equipped with resilient thrust pieces, which are linearly independent of one another in the direction of expansion, ii) and/or wherein the blind hole equipped with the resilient thrust piece is formed in a region of the insert which is not rotationally symmetrical in a narrower sense about the direction of expansion of the blind hole and is configured to cooperate with a complementarily formed region on the curved guide.

10. The insert according to claim 9, wherein each of the parts of the insert is provided with a handle recess.

11. The insert according to claim 8, wherein each of the parts of the insert is provided with a handle recess.

12. The insert according to claim 1, wherein each of the parts of the insert is provided with a handle recess.

13. A curved guide of a band-width-adjustable banderoling machine which allows the curved guide to be adapted to bands of different widths, wherein the curved guide mounted on the banderoling machine has a band-width-adjustable band guiding surface which is restricted on a first side and unrestricted on a second side, so that the curved guide can be adapted to bands of different widths by inserting an insert according to claim 1.

14. The curved guide according to claim 13, comprising a cover surrounding the band guiding surface and a volume for receiving the insert.

15. The curved guide according to claim 14, wherein a) a distance between the first and the second side of the band guiding surface is adapted to a width of the narrowest band, b) the insert is configured to be mounted relative to the band guiding surface in such a way that a distance between the restriction surface and the first side of the band guiding surface is adapted to a width of a respective desired band, and c) a distance between an inner wall of the cover and the first side of the band guiding surface is adapted to a width of the widest band.

16. The curved guide according to claim 14, wherein the insert comprises a set of at least two parts, and for each of the parts of the insert, the curved guide is equipped with a second half of the fastening system.

17. A banderoling machine with adaptable band drive, which are suitable for banderoling an object with different bands, wherein the band drive comprises a band channel and at least one drive roller, and wherein the drive roller is adapted to drive the different bands in the area of the band channel, wherein the band channel is at least partially interchangeable and can be selected to be adapted to a width and a band thickness of one of the different bands, whereby the band drive is configured to be adaptable to the different bands wherein the banderoling machine further comprises a curved guide according to claim 14, and being configured for using bands that differ in width and band thickness and be thinner than 300 μm as banderoling material.

18. The curved guide according to claim 13, wherein a) a distance between the first and the second side of the band guiding surface is adapted to a width of a narrowest band, and b) the insert is configured to be mounted relative to the band guiding surface in such a way that a distance between the restriction surface and the first side of the band guiding surface is adapted to the width of a respective desired band, and c) a distance between an inner wall of the cover and the first side of the band guiding surface is adapted to the width of the widest band.

19. The curved guide according to claim 18, wherein the insert comprises a set of at least two parts, and for each of the parts of the insert, the curved guide is equipped with a second half of the fastening system.

20. A banderoling machine with adaptable band drive, which are suitable for banderoling an object with different bands, wherein the band drive comprises a band channel and at least one drive roller, wherein the drive roller is adapted to drive the different bands in an area of the band channel, wherein the band channel is at least partially interchangeable and configured to be selected to be adapted to a width and a band thickness of one of the different bands, whereby the band drive is configured to be adaptable to the different bands, and wherein the banderoling machine further comprises a curved guide according to claim 18, and being configured for using bands that differ in width and band thickness and be thinner than 300 um as banderoling material.

21. The curved guide according to claim 13, wherein the insert comprises a set of at least two parts, and a) for each of the parts of the insert, the curved guide is equipped with a second half of the fastening system, b) wherein the fastening system allows a tool-free fastening and loosening.

22. The curved guide according to claim 21, wherein c) the fastening system is a latching system, and d) the second half of the latching system comprises a socket pin with a groove mounted on the curved guide, the socket pin configured to cooperate with the first half of the latching system located on the parts of the insert and comprising a blind hole provided with a resilient thrust piece;

e) the latching system allows a twist-proof fastening by the latching system comprising:

i) either two or more socket pins, each provided with a groove, which are linearly independent of each other in their direction of extension, ii) and/or a socket pin provided with a groove is attached to the curved guide in a region which is not rotationally symmetrical in the strict sense about the direction of expansion of the socket pin and is configured to cooperate with a complementarily formed region on the insert.

23. The banderoling machine according to claim 22, wherein f) outer dimensions of the band drive are not changed by the adaptation to bands of different widths, g) the position of a first longitudinal side of the band channel relative to the band drive is not changed by the adaptation to bands of different widths, h) the adaptation of the band drive to bands of different widths is achieved by adapting the position of a second longitudinal side of the band channel relative to the band drive, and i) adaptation of the band drive to different band thicknesses is achieved by adjusting a height of the channel cover relative to the band drive.

24. The banderoling machine according to claim 23, wherein the channel sides and the channel cover are realized by side components, and a) all side components are exchangeable, while the bottom component remains installed in the banderoling machine.

25. The banderoling machine according to claim 23, wherein b) at least one of the drive roller or a counter pressure roller thereof has a plurality of support areas arranged in such a way that i) for each of the intended widths of the bands in operation with the band inserted, ii) a distance between a first edge of the band and a first outer edge of one of the support areas which is closest to the first edge and rests on the band is equal to iii) a distance between a second edge of the band and a second outer edge of one of the support areas, which is nearest to the second edge and rests on the band, iv) and the distances are the same for all intended widths of bands.

26. A banderoling machine with adaptable band drive, which are suitable for banderoling an object with different bands, wherein the band drive comprises a band channel and at least one drive roller, wherein the drive roller is adapted to drive the different bands in an area of the band channel, wherein the band channel is at least partially interchangeable and is configured to be selected to be adapted to a width and a band thickness of one of the different bands, whereby the band drive is configured to be adaptable to the different bands, and wherein the banderoling machine further comprises a curved guide according to claim 22, and being configured for using bands that differ in width and band thickness and be thinner than 300 μm as banderoling material.

27. A banderoling machine with adaptable band drive, which are suitable for banderoling an object with different bands, wherein the band drive comprises a band channel and at least one drive roller, wherein the drive roller is adapted to drive the different bands in an area of the band channel, wherein the band channel is at least partially interchangeable and is configured to be selected to be adapted to a width and a band thickness of one of the different bands, whereby the band drive is configured to be adaptable to the different bands, and wherein the banderoling machine further comprises a curved guide according to claim 21, and being configured for using bands that differ in width and band thickness and be thinner than 300 μm as banderoling material.

28. The banderoling machine with adaptable band drive, configured for banderoling an object with different bands, wherein the band drive comprises a band channel and at least one drive roller, and wherein the drive roller is adapted to drive the different bands in the area of the band channel, wherein the band channel is at least partially interchangeable and can be selected to be adapted to a width and a band thickness of one of the different bands, whereby the band drive is configured to be adaptable to the different bands, wherein the banderoling machine further comprises a curved guide according to claim 13, and being configured for using bands that differ in width and band thickness and be thinner than 300 μm as banderoling material.

29. The banderoling machine according to claim 28, wherein the channel sides and the channel cover are realized by side components, and a) all side components are exchangeable, while the bottom component remains installed in the banderoling machine.

30. The banderoling machine according to claim 29, wherein the bottom component is provided with at least one notch and two edge steps which extend parallel to the longitudinal axis over an entire channel length, wherein a distance of facing edges of the at least one notch and one of the edge steps, is adapted to a width of a narrower band and a distance of facing edges of the two edge steps from each other is adapted to a width of the widest band, and wherein for each of the bands there are a front and a rear side member, the portions of which forming the channel side walls can engage in the corresponding notch and the associated edge step of the bottom member, so that the bottom component, front side component and rear side component complement each other to form a band channel with an internal cross-section having a width and a height adapted to a width and a band thickness of one of the different bands.

31. The banderoling machine according to claim 29, wherein b) at least one of the drive roller or a counter pressure roller thereof has a plurality of support areas arranged in such a way that i) for each of the intended widths of the bands in operation with the band inserted, ii) a distance between a first edge of the band and a first outer edge of one of the support areas which is closest to the first edge and rests on the band is equal to iii) a distance between a second edge of the band and a second outer edge of one of the support areas, which is nearest to the second edge and rests on the band iv) and the distances are the same for all intended widths of bands.

32. The banderoling machine according to claim 28, wherein b) at least one of the drive roller or a counter pressure roller thereof has a plurality of support areas arranged in such a way that i) for each of intended widths of the bands in operation with the band inserted, ii) a distance between a first edge of the band and a first outer edge of one of the support areas which is closest to the first edge and rests on the band is equal to iii) a distance between a second edge of the band and a second outer edge of one of the support areas, which is nearest to the second edge and rests on the band, iv) and the distances are the same for all intended widths of bands.

33. Adapting a banderoling machine according to claim 28 to a band having a desired width, comprising the following steps:

a) adapting the band drive to the width of the desired band and b) adapting the curved guide to the width of the desired band by inserting the insert;

wherein said insert for a curved guide of a band-width-adjustable banderoling machine which allows an adjustment of the curved guide to bands of different, desired widths, the curved guide mounted on the banderoling machine having a clear opening and outer dimensions and comprising a band guiding surface restricted on a first side and on a second side, wherein a) the insert has a clear opening which is larger than or equal to the clear opening of the curved guide and, in the assembled state, is arranged in alignment with the clear opening of the curved guide, and b) the insert has a restriction surface which, in the assembled state, is intersected by the continuation of the band guiding surface, and c) the restriction surface is selected such that, in the assembled state, the distance between the first side of the band guiding surface and the restriction surface is adapted to the desired width.

* * * * *